US006293112B1

(12) United States Patent
Moeykens et al.

(10) Patent No.: US 6,293,112 B1
(45) Date of Patent: Sep. 25, 2001

(54) FALLING FILM EVAPORATOR FOR A VAPOR COMPRESSION REFRIGERATION CHILLER

(75) Inventors: Shane A. Moeykens; James W. Larson; Jon P. Hartfield, all of La Crosse, WI (US); Harry K. Ring, Houston, MN (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/466,397

(22) Filed: Dec. 17, 1999

(51) Int. Cl.[7] ..... F25B 39/02; A23C 3/04
(52) U.S. Cl. ..... 62/84; 62/525; 165/115
(58) Field of Search ..... 62/84, 525; 165/DIG. 175, 165/172, 115, 117

(56) References Cited

U.S. PATENT DOCUMENTS

| | | | | |
|---|---|---|---|---|
| 939,143 | * | 11/1909 | Lillie | 165/117 |
| 1,937,802 | | 12/1933 | Baer . | |
| 2,012,183 | | 8/1935 | Carrier . | |
| 2,059,725 | | 11/1936 | Carrier . | |
| 2,384,413 | | 9/1945 | Zwickl . | |
| 3,213,935 | | 10/1965 | Reid, Jr. . | |
| 3,635,040 | | 1/1972 | Morris, Jr. . | |
| 4,576,222 | | 3/1986 | Granata, Jr. et al. . | |
| 5,561,987 | | 10/1996 | Hartfield et al. . | |
| 5,588,596 | | 12/1996 | Hartfield et al. . | |
| 5,638,691 | | 6/1997 | Hartfield et al. . | |
| 5,645,124 | | 7/1997 | Hartfield et al. . | |
| 5,761,914 | | 6/1998 | Carey et al. . | |
| 5,839,294 | | 11/1998 | Chiang et al. . | |
| 6,167,713 | | 1/2001 | Hartfield et al. . | |

FOREIGN PATENT DOCUMENTS

| | | | | |
|---|---|---|---|---|
| 0125588 | * | 6/1986 | (JP) | 165/117 |

* cited by examiner

*Primary Examiner*—William Wayner
(74) *Attorney, Agent, or Firm*—Wiliam J. Beres; William O'Driscoll

(57) ABSTRACT

A falling film evaporator for use in a vapor compression refrigeration chiller preferably employs a two-phase refrigerant distributor that overlies the tube bundle in the evaporator shell. The tube bundle defines at least one vapor lane which facilitates the conduct of refrigerant vapor from the interior of the tube bundle to the exterior thereof in a manner which does not substantially affect the vertically downward flow of liquid refrigerant through the tube bundle and across the vapor lane.

64 Claims, 8 Drawing Sheets

FIG. 5
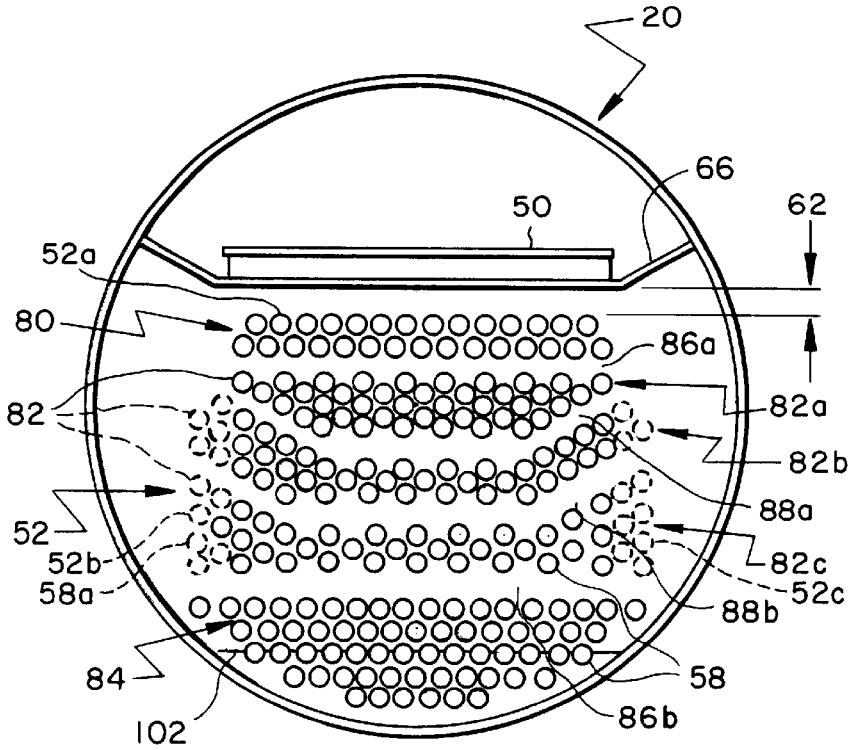
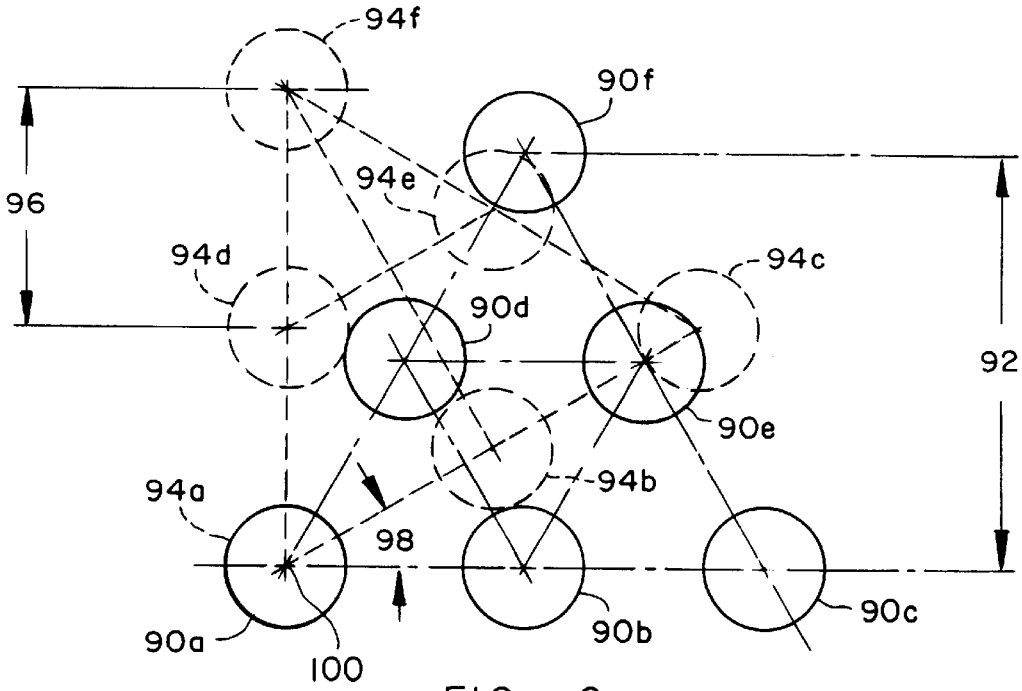
FIG. 6

FIG. 7
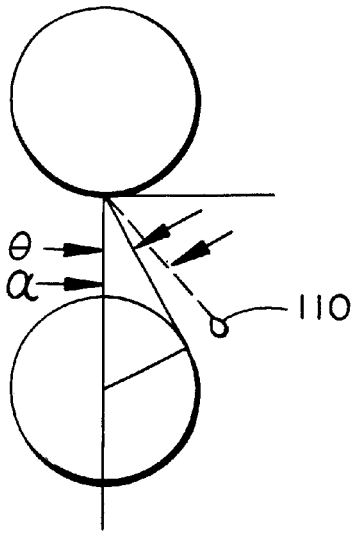
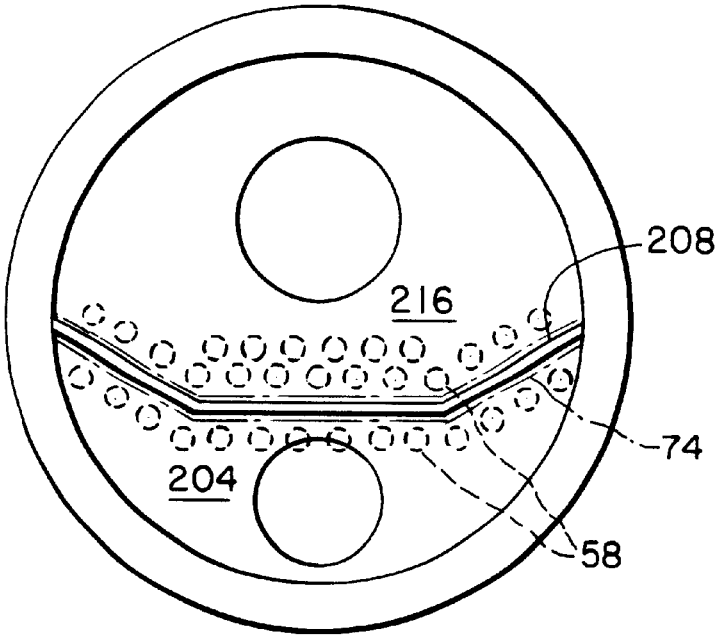
FIG. 8

FALLING FILM EVAPORATOR FOR A VAPOR COMPRESSION REFRIGERATION CHILLER

BACKGROUND OF THE INVENTION

The present invention relates to an evaporator in a refrigeration system. More particularly, the present invention relates to a falling film evaporator for a vapor compression refrigeration chiller.

At its simplest, a vapor compression refrigeration chiller includes a compressor, a condenser, an expansion device and an evaporator. Refrigerant gas is compressed in and is delivered from the compressor to the condenser, at a relatively high pressure, where the it is cooled and condensed to the liquid state. The condensed refrigerant passes from the condenser to and through the expansion device. Passage of the refrigerant through the expansion device causes a pressure drop therein and the further cooling thereof. As a result, the refrigerant delivered from the expansion device to the evaporator is generally a relatively cool, saturated two-phase mixture.

The two-phase refrigerant mixture delivered to the evaporator is brought into contact with a tube bundle disposed therein and through which a relatively warmer heat transfer medium, such as water, flows. That medium will have been warmed by heat exchange contact with the heat load which it is the purpose of the refrigeration chiller to cool.

Heat exchange contact between the relatively cool refrigerant and the relatively warm heat transfer medium flowing through the tube bundle causes the refrigerant to vaporize and the heat transfer medium to be cooled. The now cooled medium is returned to the heat load to further cool it while the heated and now vaporized refrigerant is directed out of the evaporator and is drawn into the chiller's compressor for recompression and delivery to the condenser in a continuous process.

More recently, environmental, efficiency and other similar issues and concerns have resulted in a need to re-think evaporator design in vapor compression refrigeration chillers in view of making such evaporators more efficient, from a heat exchange efficiency standpoint, and in view of reducing the size of the refrigerant charge needed in such chillers. In that regard, environmental circumstances relating to ozone depletion and global warming have taken on significant importance in the past several years. Those issues and the ramifications thereof have driven both a need to reduce the amount and change the nature of refrigerants used in refrigeration chillers.

So-called falling film evaporators have, for some time, been identified as promising candidates for use in refrigeration chillers to address efficiency, environmental and other issues and concerns in the nature of those referred to above. While the use and application of evaporators of a falling film design in vapor compression refrigeration chillers is theoretically beneficial, their design, manufacture and incorporation into such chiller systems has proven challenging.

In traditional shell-and-tube flooded evaporators, the shell of the evaporator is largely filled with liquid refrigerant and a majority of the tubes in the tube bundle are immersed therein. Two-phase refrigerant is directed upward to the evaporator's tube bundle from a distributor located at the bottom of the shell. Refrigerant vapor generated in such evaporators entrains liquid refrigerant droplets and carries them upward to the uppermost, unimmersed rows of tubes within the tube bundle for heat exchange therewith. Good axial distribution of the two-phase refrigerant mixture within the shell is important to ensure that the tube bundle is and remains fully wetted. As will be appreciated, flooded evaporators, by their nature, require that the chiller system employ a relatively large refrigerant charge.

One recent attempt to address issues relating to the amount of refrigerant used in a refrigeration system is identified in U.S. Pat. No. 5,839,294 which suggests the employment of what it refers to as a "hybrid" falling film evaporator. Despite the reference to this evaporator as a form of falling film evaporator, the '294 patent states that in its preferred embodiment, about one-half of the tubes in its tube bundle are immersed in liquid refrigerant and that in some cases, up to three quarters of the tube bundle would be. Further, that patent teaches and relies upon the use of pressure and spray heads or nozzles to distribute refrigerant onto the portion of the tubes in the tube bundle that are not immersed in liquid refrigerant. The use of pressure to spray liquid refrigerant onto a tube bundle penalizes the efficiency of the heat exchange process due to the fact that a portion of the liquid refrigerant in the spray will be carried out of the evaporator in the stream of refrigerant gas that flows to the compressor therefrom without having come into heat exchange contact with a heat exchanger tube internal of the evaporator. Further, when pressurized or spray systems are used, a larger amount of liquid refrigerant will fall into the evaporator's liquid pool without contacting a heat exchanger tube than will be the case in true or non-hybrid falling film evaporators.

Non-hybrid falling film evaporators go significantly further to reduce the amount of refrigerant needed for efficient evaporator and chiller system operation by virtue of the fact that relatively very little liquid refrigerant is carried out of the evaporator entrained in the refrigerant gas that flows out of the evaporator to the compressor and significantly less refrigerant makes its way to the bottom of the evaporator shell without having come into heat exchange contact with a tube in the tube bundle. Still further, only a relatively small portion of the tubes in the tube bundle are immersed in the relatively shallow pool of liquid refrigerant that does collect at the bottom of the evaporator shell.

In true falling film evaporators, liquid refrigerant is deposited, preferably in a low-energy, gentle fashion, onto the evaporator's tube bundle from above and gravity is relied upon to cause liquid refrigerant to fall generally vertically downward through the bundle in droplet and film form. Because of these characteristics, falling film evaporators require a reduced amount of refrigerant to function and will typically provide superior thermal performance to that of flooded and/or hybrid evaporators due to the improved heat transfer coefficient that results from the creation of the thin film of liquid refrigerant that flows over and around the majority of the individual tubes in the tube bundle. Further, evaporator efficiency and performance is improved as a result of the elimination of the adverse hydrostatic head effects caused by the relatively more large and deep pool of liquid refrigerant which is found in evaporators of the flooded type.

With respect to falling film evaporators, in operation, the vaporization of refrigerant liquid within the tube bundle of such evaporators generates vapor which tends to travel generally upward but along the path of least resistance in order to exit the but bundle. Because the refrigerant delivered onto a tube bundle in a falling film evaporator is from above and because such delivery requires the use of distributor apparatus to provide for the uniform distribution and deposit of refrigerant onto the tube bundle, generally along its entire length and width, refrigerant vapor generated in the tube bundle, which will naturally tend to rise, must be conducted both vertically and horizontally out of the tube bundle and around the refrigerant distributor so as to conduct it to a location from where it can be drawn from the evaporator into the system's compressor.

The specific vapor flow path in a tube bundle is affected by bundle geometry, tube patterns and by flow conditions therein, including vapor buoyancy effects. Managing vapor flow within the tube bundle of a falling film evaporator is therefore of significant importance to the efficiency of the heat exchange process that occurs therein as is ensuring that the flow of refrigerant, when it is initially received from the distributor at the top of the tube bundle, is "evened out" for downward flow therethrough.

If the downward flow of liquid refrigerant as it initially occurs in the upper portion of the tube bundle is not "evened out" thereacross, the efficiency of the heat transfer process within the evaporator and of the vapor compression refrigeration chiller as a whole will be degraded by oversupply of liquid refrigerant to one portion of the bundle and undersupply to another. Further, if local vapor velocity within the tube bundle becomes too high, particularly in a direction which is laterally across the tube bundle, breakdown of the film of liquid refrigerant that develops around individual tubes and the existence of which is critical to the heat transfer process can occur. Such breakdown can lead to the existence of localized dry regions in the tube bundle. The existence of such localized dry regions, or "dry out" as it is referred to, like maldistribution of the liquid refrigerant as it is initially received at the top of the tube bundle, degrades the overall heat transfer performance of a falling film evaporator.

Exemplary of the use of a true, non-hybrid falling film evaporators in vapor compression refrigeration chillers is the relatively new, so-called RTHC chiller manufactured by the assignee of the present invention. Reference may be had to U.S. Pat. Nos. 5,645,124; 5,638,691 and 5,588,596, likewise assigned to the assignee of the present invention and all of which derive from a single U.S. patent application, for their description of early efforts as they relate to the design of falling film evaporators for use in vapor compression refrigeration chillers and of refrigerant distribution systems therefor. Reference may also be had to U.S. Pat. Nos. 5,561,987 and 5,761,914, likewise assigned to the assignee of the present invention, which similarly relate to chiller systems that makes use of a falling film evaporator.

In the RTHC chiller, which is currently state of the art in the industry, the tube bundle can be categorized as being generally homogenous in terms of its tube patterns and tube bundle geometry. Proactive control of the flow of refrigerant vapor generated within the tube bundle of the RTHC chiller is not critical for the reason that a dedicated liquidvapor separator component is employed in that chiller, upstream of the evaporator's refrigerant distributor. As a result of the use of such a dedicated liquid-vapor separator component, the refrigerant delivered into the distributor within the evaporator of the RTHC chiller is in the liquid phase only. As a result of the need to distribute only liquid phase refrigerant onto the tube bundle within the RTHC evaporator, the distributor therein is of a design which does not generally inhibit the upward flow of refrigerant vapor upward and out of the evaporator. The requirement for and use of a dedicated liquid-vapor separator component does come, however, at significant expense in terms of chiller material and fabrication costs.

More recently, a refrigerant distributor of a new and highly efficient design has been developed by which the generally controlled and predictable distribution of a two-phase, vapor-liquid refrigerant mixture within a falling film evaporator in a vapor compression refrigeration system is successfully accomplished. That two-phase refrigerant distributor is the subject of co-assigned and co-pending U.S. patent application Ser. No. 09/267,413 filed on Mar. 12, 1999. The efficiency and effectiveness of this two-phase distributor has eliminated the need for a separate liquid-vapor separator component in chillers that employ falling film evaporators. While elimination of the dedicated and expensive liquid-vapor separator component is very clearly beneficial, it does come at the cost of adding some complexity and design difficulties to the overall evaporator design.

In that regard, in order for a distributor to accomplish efficient and even distribution of two-phase refrigerant to the tube bundle in a falling film evaporator, it will typically be of a generally solid and impervious design that will overlie the majority of the length and width of the evaporator's tube bundle. Distributors of such a design do not, therefore, generally facilitate the unobstructed vertical flow of refrigerant vapor to and out of the upper region of the evaporator.

Because the two-phase refrigerant distributor is a generally impervious component that overlies the majority of the length and width of the tube bundle, refrigerant vapor generated within the tube bundle must be caused to flow horizontally, in a cross-flow direction with respect to the downward flow of liquid refrigerant through the tube bundle, in order to conduct such vapor to the sides of the tube bundle from where it can be drawn upward and out of the evaporator shell unobstructed by the distributor. Such flow must be managed to minimize both the disruption of the distribution of refrigerant out of the distributor onto the top of the tube bundle and the downward flow of liquid refrigerant through the tube bundle.

The need therefore exists for a falling film evaporator for use in a vapor compression refrigeration system in which the need for a dedicated liquid-vapor separator component is obviated by the use of a two-phase refrigerant distributor yet which provides for the pro-active control of the flow of refrigerant vapor within and out of its tube bundle and shell in a manner which minimizes the disruption of the distribution of refrigerant onto the tube bundle from above and the downward flow of liquid refrigerant therethrough.

SUMMARY OF THE INVENTION

It is a primary object of the present invention to provide for the control of vapor flow within a tube bundle in an evaporator of the falling film type in which a refrigerant distributor is employed.

It is another object of the present invention to provide a tube bundle for use with a two-phase refrigerant distributor in a falling film evaporator in a vapor compression refrigeration systems which obviates the need for a vapor liquid separator in such system.

It is an additional object of the present invention to provide a falling film evaporator in which the distribution of liquid refrigerant onto the top of the tube bundle is in controlled and predictable quantities.

It is another object of the present invention to provide a falling film evaporator which, by its employment of appropriately sized and positioned vapor lanes, is capable of conducting refrigerant gas out of the tube bundle therein without substantially disrupting the downward flow of liquid refrigerant therethrough.

It is a further object of the present invention to prevent the local "dryout" of tube surfaces in the tube bundle of a falling film evaporator by conducting refrigerant gas created within the bundle laterally thereoutof in a controlled manner which minimizes the stripping of liquid refrigerant from the surfaces of individual tubes within the bundle.

It is a still further object of the present invention to provide a tube bundle for a falling film evaporator in which the geometry thereof is optimized so as to "even out", quickly and in the upper portion thereof, the flow of liquid refrigerant received from a two-phase refrigerant distributor disposed vertically above the tube bundle and to optimize the tube pattern/geometry lower in the bundle to take advantage of the homogeneous downward flow of liquid refrigerant that will have been established as a result of the evening out of liquid flow in the upper portion of the bundle.

It is an additional object of the present invention to provide an evaporator in which the efficiency of the heat exchange process is enhanced by its avoidance of the use of pressure to spray refrigerant onto the evaporator tube bundle.

It is another object of the present invention to provide for the efficient vaporization of liquid refrigerant in a falling film evaporator and to obviate the need to recirculate or redeposit any such refrigerant that makes its way to the bottom of the evaporator shell.

It is a still further object of the present invention to reduce the exit velocity of refrigerant vapor generated in the tube bundle of a falling film evaporator and to prevent the stripping of liquid refrigerant film from the tubes thereof by such gas through the use of vapor lanes sized and located within the tube bundle to accomplish that purpose.

It is also an object of the present invention to provide a falling film evaporator in which the tube bundle thereof defines vapor lanes for the conduct of refrigerant gas thereoutof and in which the waterbox pass partitions of the evaporator are configured to coincide with such vapor lanes so as to simplify and reduce the expense of evaporator and waterbox construction.

It is a still further object of the present invention to provide a tube bundle for a falling film evaporator which, by its nature, by its tube pattern and by its use of vapor lanes, is amenable to accommodating tubes of several diameters and pitch spacings and of being replicated within a common evaporator shell in a modular fashion so as to provide for evaporators of different capacities and efficiencies but which use a common shell.

These and other objects of the present invention, which will become apparent when the following Description of the Preferred Embodiment and appended drawing figures are considered, are achieved by the use vapor lanes and optimized tube bundle geometry in a falling film evaporator that employs a two-phase refrigerant distributor. The vapor lanes and tube geometry control the cross-flow velocity of the refrigerant gas created interior of the bundle. That gas must pass laterally out of the tube bundle and around the distributor in order to exit the evaporator shell and to enter the compressor in the refrigeration system in which the evaporator is employed. Control of the cross-flow velocity of refrigerant gas flowing out of the interior of the evaporator's tube bundle is accomplished, in the preferred embodiment, by efficiently distributing two-phase refrigerant into the evaporator shell generally across the length and width of the tube bundle and by the definition of vapor lanes within the tube bundle that facilitate the passage of refrigerant gas out of the bundle in a manner which minimizes the disruption of the downward flow of liquid refrigerant through the bundle and the heat exchange process ongoing therein. By appropriately managing the distribution and flow of liquid refrigerant downward through the bundle as well as the lateral or cross-flow of refrigerant vapor out of the bundle and by locating the vapor lanes used in vapor flow management to coincide with the waterbox pass partitions of the evaporator, not only is the heat transfer process within the evaporator enhanced but the fabrication and material cost thereof is significantly reduced.

DESCRIPTION OF THE DRAWING FIGURES

FIG. 5 is a cross-sectional view of the falling film evaporator of the present invention illustrating the tube bundle configuration of the preferred embodiment thereof.

FIG. 6 graphically illustrates the terms triangular pitch and rotated triangular pitch as applied to tubes in a heat exchanger tube bundle.

FIG. 7 illustrates the effect of vapor cross-flow on liquid refrigerant droplets in a falling film evaporator.

Figure 3:
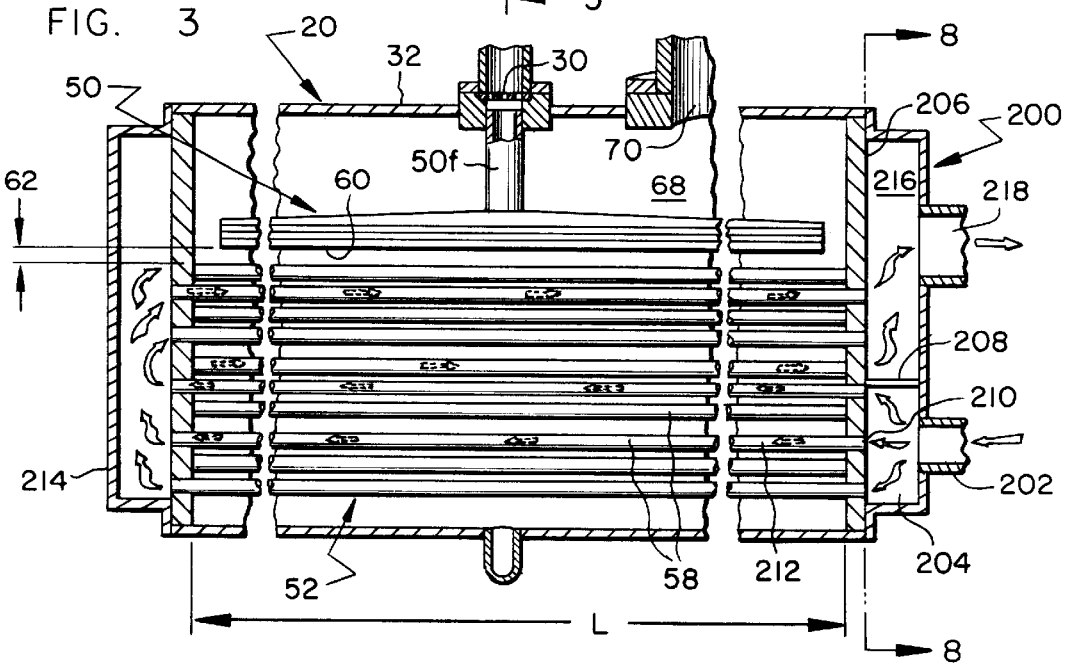

FIG. 8 is a view taken along line 7—7 of FIG. 3.

Figure 9:
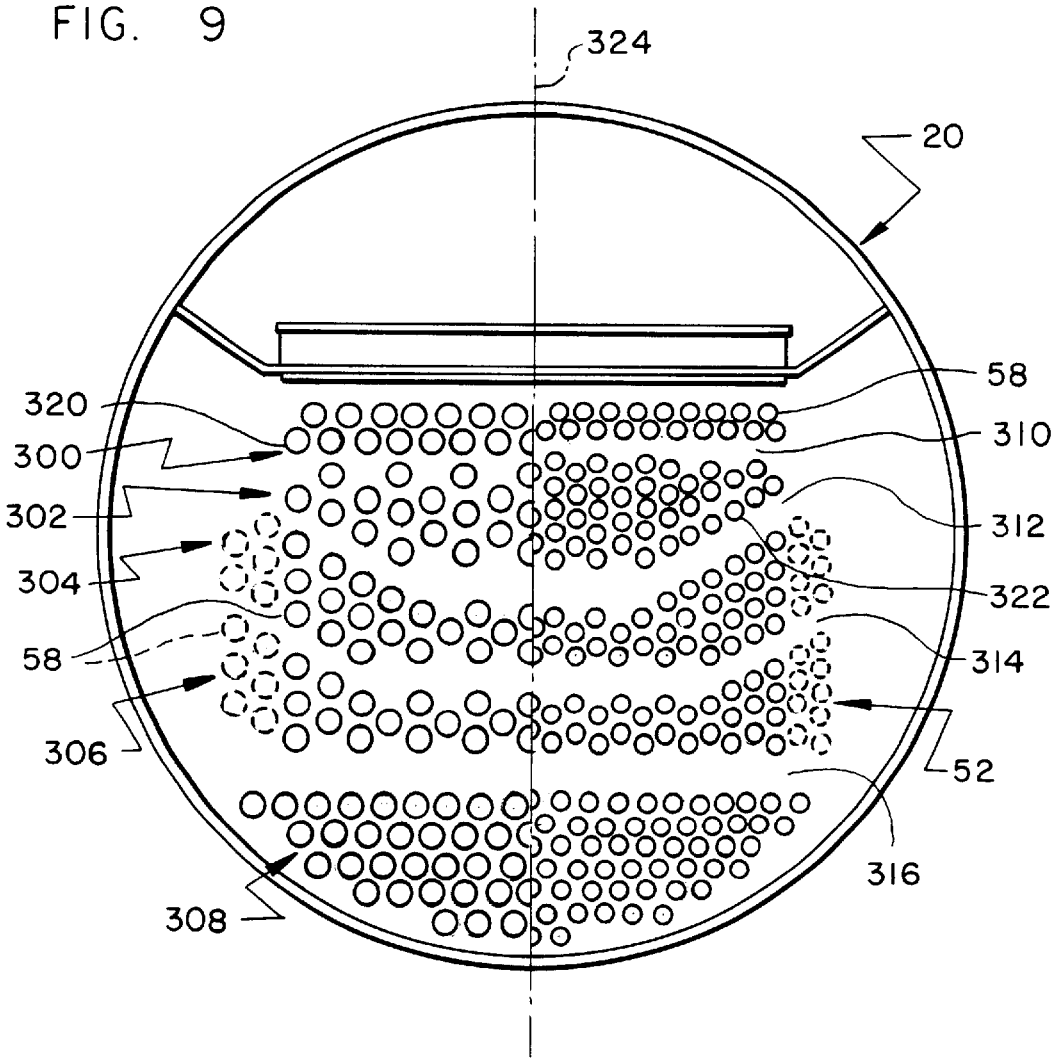

FIG. 9 illustrates generally how tubes and tube bundles of different diameter and spacing can be accommodated in the falling film evaporator of the present invention, such different tube bundle configurations capable of making use of vapor lanes of the same size and location and therefore common water boxes and water box baffles.

Figure 10:
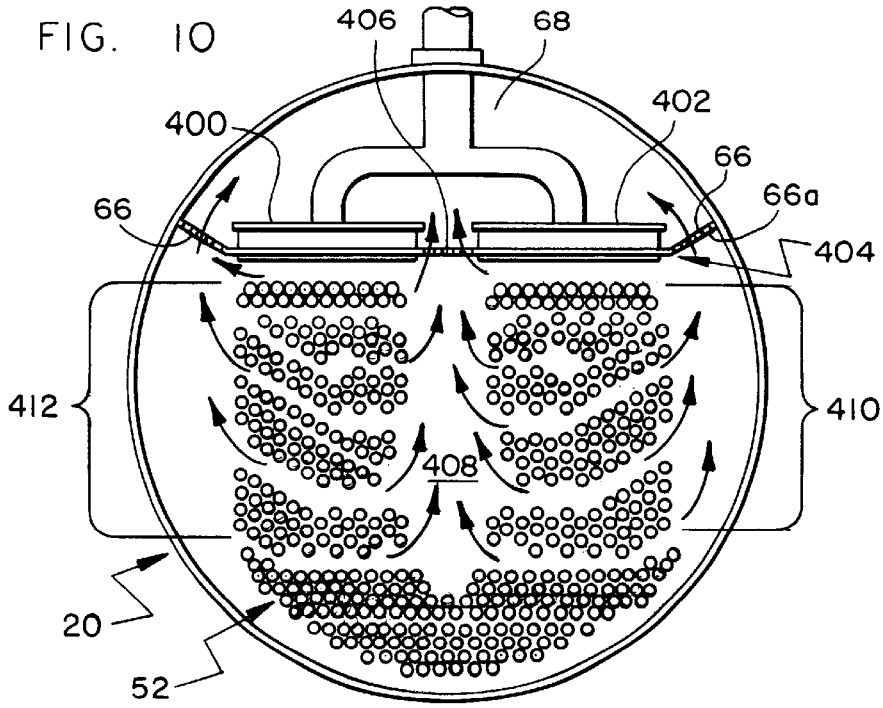

FIG. 10 illustrates an alternative embodiment of the present invention in which multiple refrigerant distributors are employed.

Figure 11:
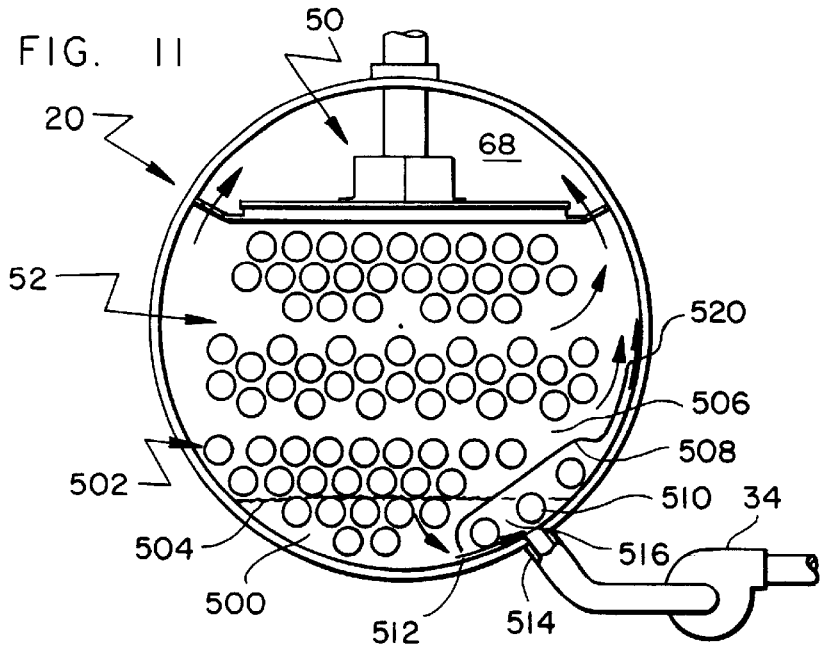

FIG. 11 schematically illustrates the addition of an oil concentrator in the evaporator of the present invention.

DESCRIPTION OF THE PREFERRED EMBODIMENT

Figure 1:
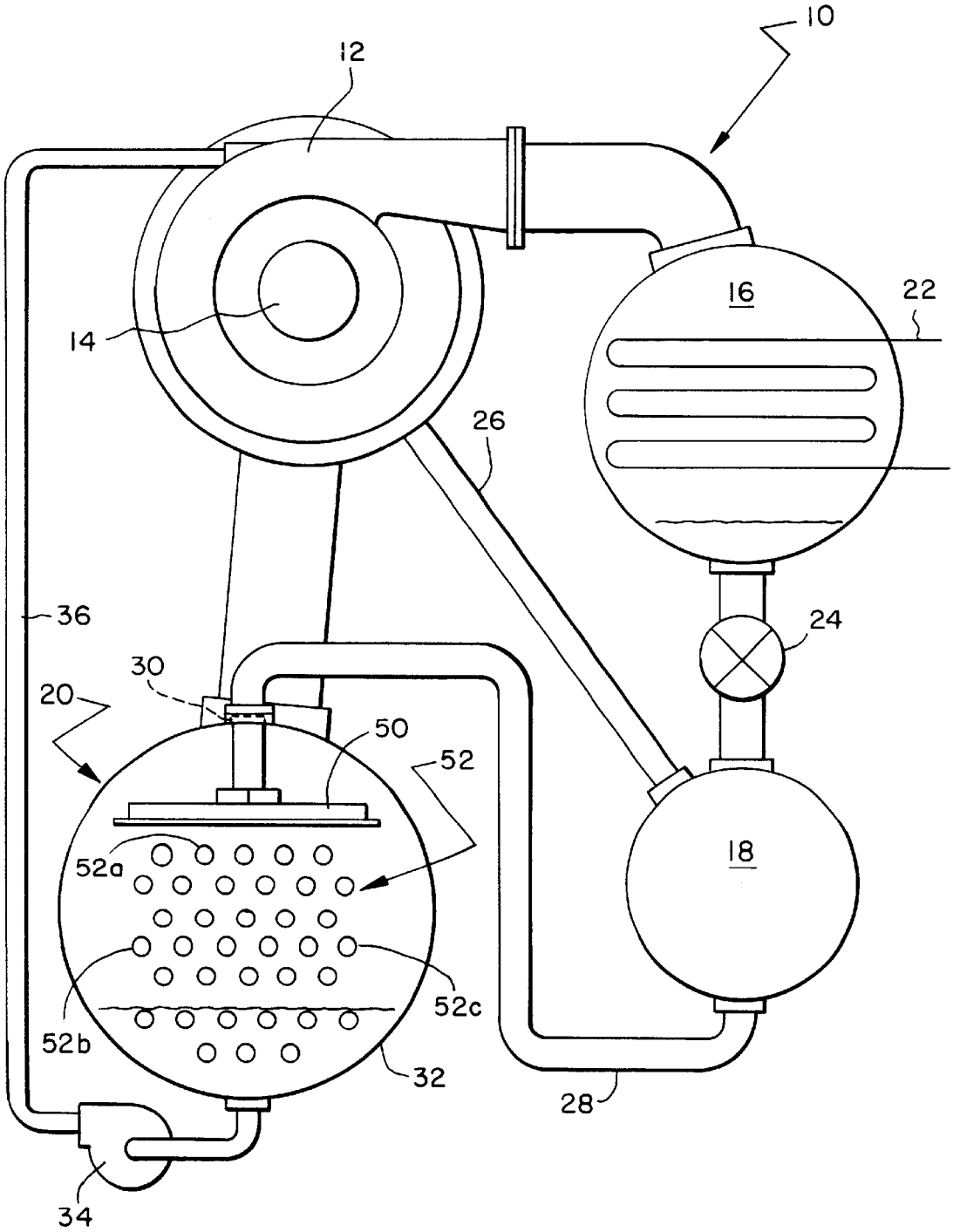
FIG. 1 is a schematic illustration of the water chiller of the present invention in which the falling film evaporator is employed.

Referring first to FIG. 1, the primary components of chiller system 10 of the preferred embodiment are a compressor 12, which is driven by a motor 14, a condenser 16, an economizer 18 and an evaporator 20. The compressor, condenser, economizer and evaporator are serially connected for refrigerant flow in a basic refrigerant circuit as will more thoroughly be described.

Compressor 12 is, in the preferred embodiment, a multistage compressor of the centrifugal type. It is to be understood, however, that the use of falling film evaporators of the type described herein in chillers where the compressor is of other than the centrifugal type is contemplated and falls within the scope of this invention.

Generally speaking, the relatively high pressure refrigerant gas delivered into condenser 16 from compressor 12 is condensed to liquid form by heat exchange with a relatively cooler fluid, most typically water, which is delivered into the condenser through piping 22. As will be the case in most chiller systems, a portion of the lubricant/oil used within the compressor will be carried out of the compressor entrained in the high pressure gas that is delivered thereoutof to the condenser. Any lubricant entrained in the compressor discharge gas will fall or drain to the bottom of the condenser and make its way into the liquid refrigerant pooled there.

The liquid pooled at the bottom of the condenser, including the oil therein, is driven by pressure out of the condenser and to and through, in the case of the preferred embodiment, a first expansion device 24 where a first pressure reduction in the refrigerant occurs. This pressure reduction results in the creation of a two-phase refrigerant mixture downstream of the first expansion device which generally carries any lubricant that has made its way into the condenser along with it. This two-phase refrigerant mixture and any lubricant flowing therewith is next delivered into economizer 18. From there, the majority of the gaseous portion of the refrigerant, which is still at a relatively elevated pressure, is delivered through conduit 26 back to compressor 12 which, in the case of the preferred embodiment, is a two-stage compressor.

The delivery of such gas back to compressor 12 is to a location where the refrigerant undergoing compression is at a relatively lower pressure than the gas delivered thereinto from the economizer. The delivery of the relatively higher pressure gas from the economizer into the lower pressure gas stream within the compressor elevates the pressure of the lower pressure refrigerant by mixing with it, without the need to expend energy in mechanical compression to do so. The economizer function is well known and it is to be understood that while the preferred embodiment describes a chiller in which a multiple-stage centrifugal compressor and an economizer are employed, the present invention is equally applicable, not only to chillers driven by other kinds of compressors, but to chillers which employ only a single compression stage and/or to chillers which may or may not employ an economizer component.

The refrigerant not delivered back to the compressor through conduit 26 exits economizer 18 and passes through piping 28 to a second expansion device 30. Second expansion device 30 is preferably and advantageously disposed in or at the top of shell 32 of evaporator 20, proximate the inlet to refrigerant distributor 50 which is disposed therein although it need not be. The preferred embodiment of distributor 50 itself and its application in a falling film evaporator in the general sense are the subject of U.S. patent application Ser. No. 09/267,413, filed Mar. 12, 1999 and assigned to the assignee of the present invention.

A second pressure reduction in this refrigerant occurs as a result of its passage through expansion device 30 and a relatively cool, relatively low pressure two-phase refrigerant mixture is delivered from second expansion device 30, together with any lubricant being carried therein, into distributor 50. By positioning expansion device 30 adjacent the entrance to distributor 50, reduced stratification in the flow of the two-phase refrigerant mixture into and through the distributor, which can be created if the flow path for refrigerant from the expansion device into distributor 50 is lengthy, is achieved and the ability of the distributor to deliver two-phase refrigerant in a more controlled, predictable and, in the preferred embodiment, uniform manner across the length and width of tube bundle 52 is enhanced.

Tube bundle 52 has a generally horizontal top 52*a* and two generally vertical exterior sides 52*b* and 52*c*. Once deposited onto the top of tube bundle 52 liquid refrigerant and oil trickle downward through the tube bundle, in a manner that will be further described. A portion of this liquid refrigerant and oil will make its way to the bottom of the evaporator shell and will form a pool 54 thereat. From there, the oil will be returned to the compressor, such as by pump 34 and oil return line 36, as will further be described.

Figure 2:
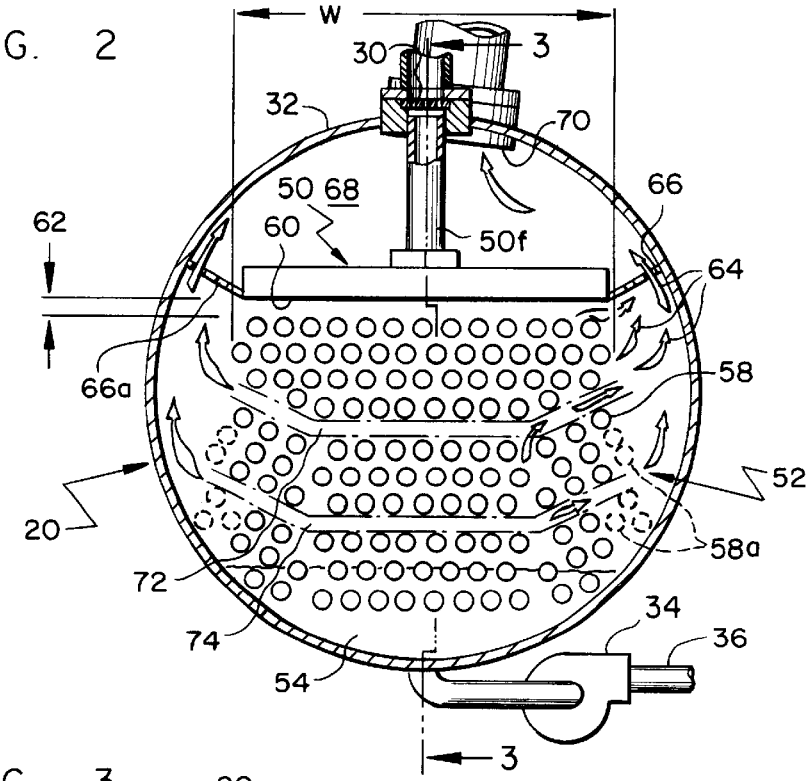
FIGS. 2 and 3 are schematic end and lengthwise cross-sectional views of the falling film evaporator of the present invention.

Referring additionally now to FIGS. 2, 3 and 4, the preferred embodiment of the falling film evaporator 20 of the present invention is schematically illustrated in end and lengthwise cross-sectional views thereof. As will be appreciated, refrigerant distributor 50, around which refrigerant gas must flow in order to exit evaporator 20, extends along at least the majority of the length L and width W of at least the upper portion of tube bundle 52 within evaporator 20. The greater the extent to which the length and width of the tube bundle is overlain by distributor 50, the more efficient will be the heat exchange process within evaporator 20 due to the more complete wetting and productive use of the tube surface available in the evaporator for heat transfer purposes.

Figure 4A:
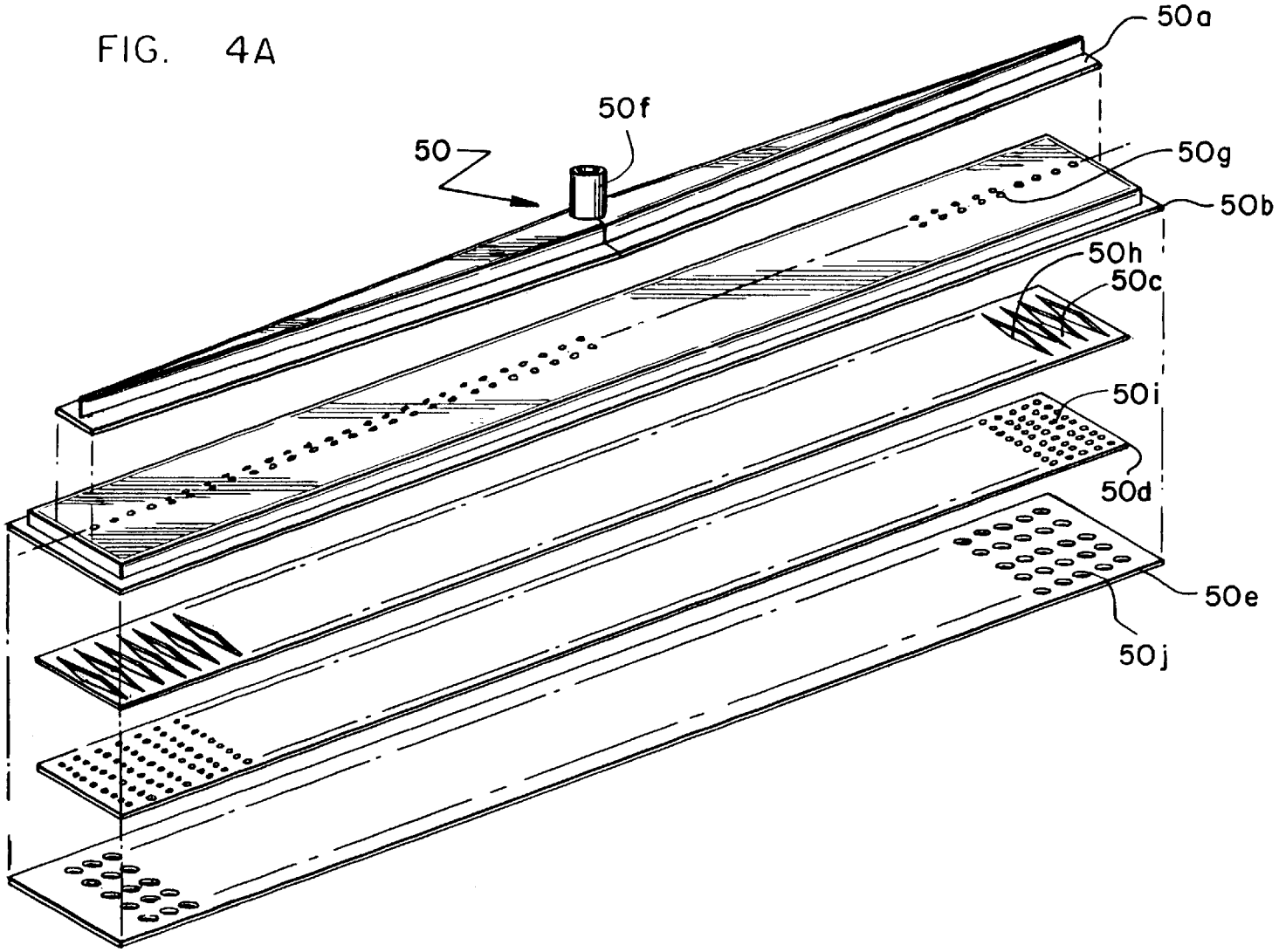
FIG. 4A is an exploded view of the preferred two-phase refrigerant distributor employed in the evaporator of the present invention.
Figure 4B:
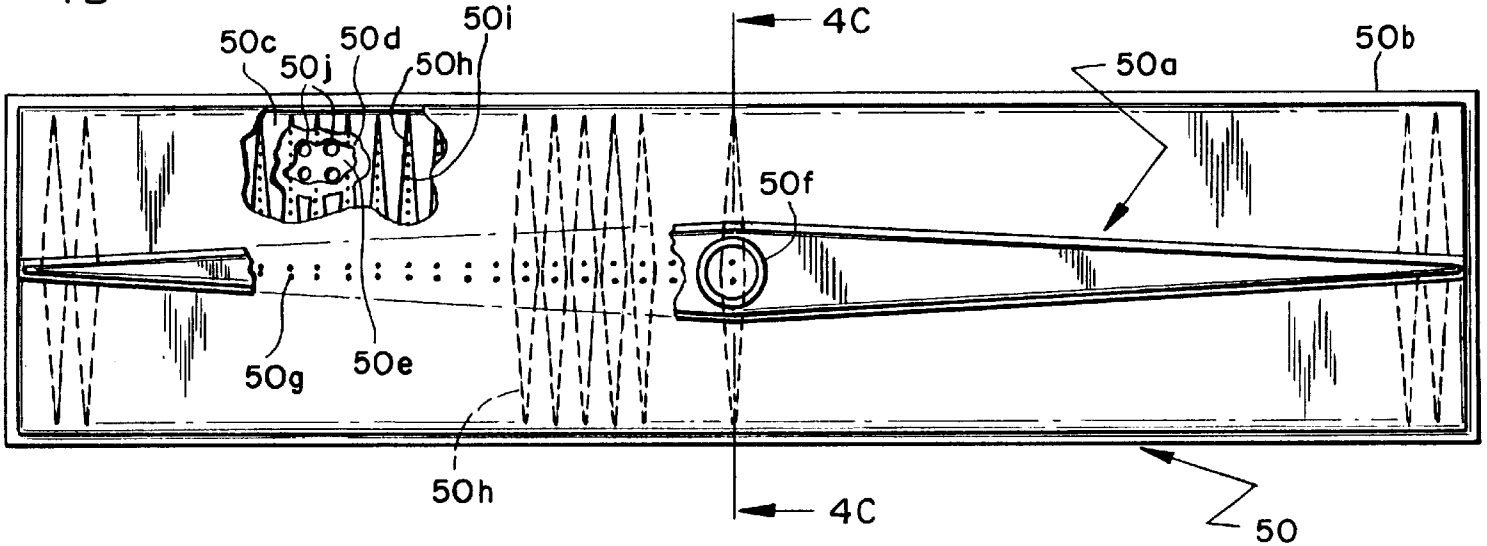
FIG. 4B is a partial cutaway top view of the refrigerant distributor of FIG. 4A.
Figure 4C:
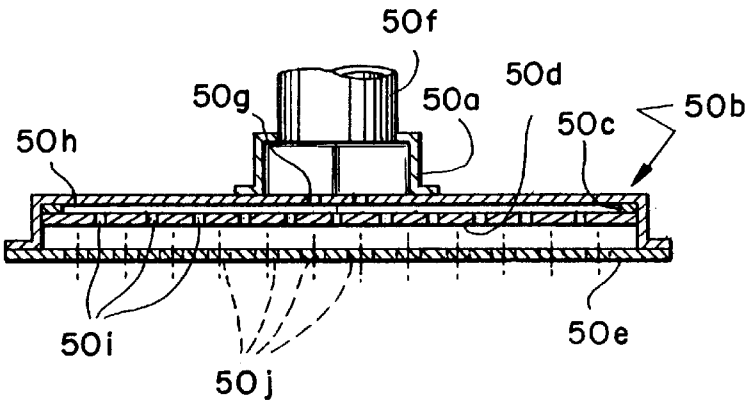
FIG. 4C is a view taken along line 4C—4C of FIG. 4B.

Referring now primarily to FIGS. 4A–C, refrigerant distributor 50, which in the preferred embodiment is the two-phase distributor taught and claimed in above-referenced U.S. patent application Ser. No. 09/267,413, includes a first stage distributor section 50*a* which overlies a cover plate 50*b*. Ensconced within cover plate 50*b* are a second stage distributor plate 50*c* and an injection plate 50*d*. Bottom plate 50*e* covers the underside of distributor 50. Generally speaking, two-phase refrigerant enters distributor 50 through inlet 50*f* and flows bi-directionally to the ends of first stage distributor portion. Along the way, two-phase refrigerant passes through apertures 50*g* in cover plate 50*b* and enters the diamond shaped slots 50*h* in distributor plate 50*c*. As a result of such flow, two-phase refrigerant will have been distributed in a controlled and predictable manner generally along the length and width of distributor 50 and, therefore, along the length and width of tube bundle 52 in the process.

The refrigerant next flows through injection holes 50*i* that are defined in plate 50*d*, such holes being relatively small and located in rows which underlie one of the diamond-shaped slots 50*h* in plate 50*c*. Because it is at a pressure greater than the pressure in the evaporator shell, the refrigerant sprays through holes 50*i* and impinges upon solid portions of bottom plate 50*e*. However, because there is a volume or space between plate 50*d* and bottom plate 50*e* of the distributor, the relatively higher pressure two-phase refrigerant that passes through injection holes 50*i* and which impinges on solid portions of bottom plate 50*e* loses the majority of its kinetic energy in the process.

As a result, liquid trickles out of relatively large apertures 50*j* in bottom plate 50*e* generally unassisted by pressure and due to the force of gravity and distributor 50 distributes liquid refrigerant in predictable and controlled quantities over the portion of the top of the tube bundle it overlies. In the preferred embodiment, though not necessarily in other embodiments, such quantities will generally be uniform across the overlain portion of the top of the tube bundle. Any refrigerant gas entering distributor 50 or generated therein passes out of apertures 50*j*, which, once again, are relatively large, and is conducted away from distributor 50 in a manner which is described below but which does not generally affect the vertically downward deposit of liquid refrigerant from the distributor onto the top of the tube bundle.

It is to be understood, with respect to the evaporator of the present invention, that distributor 50 will preferably be any kind of distributor which is capable of successfully distributing two-phase refrigerant across a tube bundle in the absence of dedicated liquid-vapor separation apparatus or methodology the purpose of which is to separate refrigerant gas from refrigerant liquid in or upstream of the refrigerant distributor internal of the evaporator shell. The particular two-phase distributor illustrated in FIGS. 4A–C, while preferred, is presented only with respect to its ability to successfully distribute a two-phase refrigerant mixture across a tube bundle in a controlled and predictable manner and is not, in its detail and workings, presented in any way to restrict or affect the scope of the present invention. Therefore, two-phase refrigerant distributors of other designs are contemplated and fall within the scope of the present invention. Still further, however, the present invention, in its broadest sense, has application in systems where a distributor is employed which is designed to distribute single-phase liquid refrigerant. Once again, however, in its preferred embodiment, the present invention has been designed in view of vapor compression refrigeration systems employing a falling film evaporator in which a two-phase refrigerant distributor that uniformly distributes liquid refrigerant onto the top of the evaporator tube bundle is employed.

By the use of a two-phase refrigerant distributor, the need for a separate and/or dedicated liquid-vapor separator component or structure within chiller system 10, upstream of the evaporator's refrigerant distributor, is eliminated. However, because distributor 50, in the preferred embodiment, receives and distributes a two-phase refrigerant mixture, it is a structure which generally overlies and does not readily facilitate the unobstructed upward flow of refrigerant gas within the evaporator shell to a location from where it can be drawn into compressor 12. Therefore, provision must be made to efficiently conduct refrigerant gas that is generated in or received into the interior of the evaporator upward from tube bundle 52 and around distributor 50. The conduct and movement of such gas must be in a manner which minimizes the disruption and/or adverse effects thereof on the downward flow of liquid refrigerant through the tube bundle and on the heat exchange process occurring therein.

Tube bundle 52 is comprised of a plurality of horizontally running individual tubes 58 which are positioned, as will more thoroughly be described, in a pattern under distributor 50 to maximize contact with the liquid refrigerant that issues out of the lower face 60 of distributor 50 onto the upper portion of the tube bundle. Such liquid refrigerant is in the form of relatively large, low energy droplets.

In addition to the relatively large droplets of liquid refrigerant that dribble out of the distributor onto the tube bundle, at least some refrigerant gas, formed by flashing internal of the distributor or upstream thereof, will issue out of distributor 50 and will preferably be immediately directed laterally outward and around the distributor into the upper portion of the evaporator without significantly disrupting the deposition of liquid refrigerant droplets onto the tubes in the upper portion of the tube bundle. For that reason, a vapor space 62 is defined between the top of the tube bundle and the lower face 60 of the refrigerant distributor. The vapor space, by its sizing, facilitates the lateral movement of gas that issues directly out of distributor 50 while minimizing the effect thereof on the deposit of the liquid refrigerant droplets onto the tube bundle. In a refrigeration system wherein a single-phase liquid refrigerant distributor is employed within the evaporator of the present invention, the need for vapor space 62 would be eliminated since little gas is generated in or issues from such a distributor.

The gas issuing out of the distributor and which is conducted out of vapor space 62, in the preferred embodiment, combines at the upper periphery of tube bundle 52 with the refrigerant gas that is generated by the heat exchange process that occurs within the tube bundle. This gas then passes upward and around distributor 50, as indicated by arrows 64, and flows through suction baffles 66 which also serve as mounting flanges for the distributor within the evaporator shell. Baffles 66 define perforations 66*a* along their length and, in the preferred embodiment, run generally the full length of the distributor.

Flanges 66 position/support distributor 50 within the evaporator shell and distribute/regulate the flow of refrigerant vapor into the upper portion 68 thereof which is generally above distributor 50 and flanges 66. As such, flanges 66 function as a suction baffle by which the flow of refrigerant vapor into the upper portion 68 of evaporator 20 is distributed/regulated, generally along the length of the evaporator shell, prior to being drawn from upper portion 68 of the evaporator into the compressor 12 of system 10 through vapor outlet 70. Such distribution/regulation makes the flow of gas out of the evaporator and to the suction side of the compressor more uniform. By configuring and using the flanges 66 for this purpose, the need for a discrete and separate suction baffle mounted within upper portion 68 of evaporator shell 32 is eliminated. Further, the perforated flanges act as a barrier to the movement of liquid refrigerant out of the lower portion of the evaporator shell into upper portion 68.

The efficient operation of falling film evaporator 20 is predicated on the controlled, predictable and, in the preferred embodiment, uniform deposition of liquid refrigerant onto the upper surface of tube bundle 52 at relatively low velocity and in relatively low-energy droplet form, the creation by such droplets of a film of liquid refrigerant around the individual tubes in the tube bundle and the falling of any refrigerant which remains in the liquid state after contact with a tube, still in low-energy droplet form, through vapor lanes 72 and 74, as will further be described, and onto other tubes lower in the tube bundle where a film of liquid refrigerant is similarly formed therearound.

Referring additionally now to Drawing FIG. 5, the pattern and nature of the individual tubes 58 in tube bundle 52 of the preferred embodiment is illustrated and will more thoroughly be described. As will be appreciated, the tubes and tube pattern in the tube bundles illustrated in Drawing FIGS. 2 and 3 are meant only to illustrate the evaporator of the present invention in a more general sense whereas the more detailed tube bundle pattern/configuration is preferred.

Generally speaking, tube bundle 58 is comprised, in the preferred embodiment, of an upper triangular-pitch tube section 80, one or more rotated triangular-pitch tube sections 82 therebelow and a lower, preferably triangular-pitch tube section 84, generally at the bottom of the evaporator shell. The individual tube sections are separated/defined by vapor lanes, such lanes being avenues which are generally unobstructed by individual tubes and which facilitate the flow of refrigerant gas generated internal of the tube bundle laterally and/or diagonally thereoutof while minimizing the disruption of the downward flow of liquid refrigerant droplets therethrough.

In the preferred embodiment of FIG. 5, a horizontal vapor lane 86*a* is defined between upper triangular-pitch tube section 80 and rotated triangular-pitch tube section 82*a* which is immediately therebelow. Rotated triangular-pitch tube section 82*b* is separated from rotated triangular-pitch tube section 82*a* by diagonal vapor lane 88*a* while rotated triangular-pitch tube section 82*c* is separated from rotated triangular-pitch tube section 82*b* and from lower triangular-pitch tube section 84 by diagonal vapor lane 88*b* and horizontal vapor lane 86*b* respectively. Tube bundle 58 can, in some cases, include individual tubes 58*a* in a lower portion thereof which are outside of the area of tube bundle 52 overlain by distributor 50. Such tubes are shown in phantom in FIG. 5 and their use is made possible by arranging the tubes within tube bundle 52 to facilitate the horizontal flow of liquid refrigerant to such tubes as will more thoroughly be described.

Referring additionally now to FIG. 6, an explanation of the terms "triangular-pitch" and "rotated triangular-pitch" as they apply to tube bundle sections 80, 82*a*, 82*b*, 82*c* and 84 will be provided. Bundle sections 80 and 84 have been referred to as "triangular-pitch" tube sections while sections 82*a*, 82*b* and 82*c* have been referred to as "rotated triangular-pitch" bundle sections. Tubes 90*a*, 90*b*, 90*c*, 90*d*, 90*e* and 90*f* are illustrated in FIG. 6 in triangular-pitch configuration. The vertical distance between such tubes and the tube which is vertically beneath them in the tube bundle is illustrated at 92. Tubes 94*a*, 94*b*, 94*c*, 94*d*, 94*e* and 94*f* are illustrated in rotated triangular-pitch configuration. The vertical distance between tubes in this pitch configuration is illustrated at 96. Since the triangles formed by the centers of tubes in both configurations are typically isosceles in nature, the rotated triangular-pitch configuration is arrived at simply by rotating the triangular-pitch configuration 30° around the common center 100 of tubes 90*a* and 94*a*, which, for purposes of illustration and explanation, coincide in FIG. 6.

As will be appreciated, the distance 96 between vertically adjacent tubes in a rotated triangular-pitch configuration is less than the vertical distance 92 between vertically adjacent tubes in a triangular-pitch configuration. As will further be appreciated, tubes in vertically adjacent horizontal rows which are oriented in rotated triangular-pitch configuration are immediately above and below each other so that liquid refrigerant drips or falls from a first horizontal tube row directly downward onto tubes in the horizontal tube row immediately below. Where tubes are oriented in triangular pitch, the tubes in vertically adjacent horizontal rows do not align vertically so that liquid refrigerant falling off of a first tube does not fall onto a tube in the horizontal row of tubes immediately below.

If perfectly uniform initial liquid refrigerant distribution were obtainable across the top of a tube bundle and liquid refrigerant was not susceptible to being horizontally displaced in its downward flow therethrough, the pattern of the tube bundle would preferably and consistently be of the rotated triangular-pitch type throughout the bundle because the vertical distance between tubes in that configuration is shorter, making for a more compact heat exchanger. However, because initial refrigerant distribution across the top of a tube bundle is generally but not perfectly uniform and in order to promote refrigerant mixing so as to further even out the distribution and availability of liquid refrigerant as near to the top of a tube bundle as is possible, it has been found that the use of tubes in the triangular-pitch pattern in the upper portion of the tube bundle is beneficial. It must be realized, however, that the vertical and horizontal spacing between individual tubes in any section of the tube bundle will vary from one evaporator/application/size/configuration to the next and even within individual tube sections of a tube bundle and that nothing herein is meant to suggest or limit the scope of the present invention to tubes within a tube bundle that are horizontally and/or vertically equally spaced or spaced or configured in one particular fashion or another.

Referring back now to FIGS. 1, 2, 3, 4A, 4B, 4C and 5, two-phase refrigerant mixture is introduced into vapor space 62 from distributor 50. The vapor portion thereof will, for the most part, flow laterally through and out of the vapor space although a portion of such vapor, as well as vapor which is created by the contact of liquid refrigerant with tubes in tube bundle sections 80 and 82*a*, will make its way into horizontal vapor lane 86*a* from where it will be conducted, following the path of least resistance offered by the vapor lane, to the outer upper periphery of the tube bundle.

The liquid portion of the mixture deposited onto the top 52*a* of the tube bundle flows downward, first through tube section 80, wherein the flow of such liquid refrigerant is generally evened out and distributed across the width of the bundle as a result of the triangular-pitch tube pattern employed, and makes its way across vapor lane 86*a* into tube section 82*a*. The flow of liquid refrigerant continues downward within the tube bundle through tube sections 82*b* and 82*c* and across vapor lanes 88*b* and 86*b* respectively until any remaining liquid refrigerant and any oil entrained therein makes its way to and pools in the bottom of evaporator 20, nominally at a level indicated at 102, where tube section 84 is found. Such refrigerant undergoes flooded heat exchange contact with the portion of the tubes of tube section 84 that are immersed in such liquid while the oil-rich fluid located there is returned to the system compressor by pump 34 through line 36. The efficiency of the vaporization process eliminates the need for means, such as a pump, for recirculating liquid refrigerant within the evaporator to bring it into contact with tubes in the tube bundle a second or additional times to achieve vaporization.

It is to be understood that the downward flow of liquid refrigerant in a falling film evaporator is preferably in low energy, low velocity droplet form with any liquid refrigerant that remains in the liquid state after flowing as a film around a tube surface coalescing to form droplets or, in some instances, a curtain or sheet of liquid at the bottom of such tube which falls gently onto a tube vertically below it in the tube bundle. Such refrigerant, after being deposited onto a lower tube, re-form as a film thereon and flow downward across the surface thereof with any unvaporized portion of such liquid, in the same manner, again coalescing at the bottom of such lower tube. By the creation of a film of liquid refrigerant around the individual tubes in a tube bundle, the efficiency of the process by which heat is transferred from the fluid flowing internal of a tube to refrigerant film coating the exterior of the tube is enhanced as is the overall efficiency of the evaporator as a whole. To the extent that conditions exist within the tube bundle of a falling film evaporator that cause liquid refrigerant to be blown off of individual tubes or to become entrained in refrigerant vapor in mist form, however, the efficiency of the heat transfer process suffers.

With the above in mind, vapor lanes 86*a*, 86*b*, 88*a* and 88*b* facilitate the flow of refrigerant vapor out of the interior of tube bundle 52 to the exterior sides 52*b* and 52*c* thereof in a controlled manner which minimizes the effect of vapor crossflow on the downward flow of liquid refrigerant droplets thereacross. As will be appreciated, vapor lanes 86*a* and 86*b* are generally horizontal while vapor lanes 88*a* and 88*b* are generally horizontal but have a vertically upward bias at their exterior ends.

In determining the proper size for a vapor lane, the thermophysical properties of the refrigerant, the expected liquid refrigerant droplet diameter and the expected local vapor velocities are taken into account. Vapor velocity and mean liquid refrigerant droplet diameter do vary locally throughout a tube bundle and must be accounted for in calculating the preferred size of the vapor lanes. Critical to such analysis are two factors, the first being Weber number determination and the second being local droplet deflection.

The Weber number is a quantity associated with inertial and surface tension forces that exist in a gas-liquid droplet system. As is known to those skilled in the art, if the Weber number exceeds a certain critical value, vapor cross-flow will disrupt falling liquid droplet flow between tube rows in a heat exchanger and will result in the creation of still fine droplets thereof. Such relatively still smaller droplets have the tendency to become entrained in the refrigerant vapor flowing within the tube bundle. The entrainment of such droplets forms a mist and a more or less homogenous two-phase flow pattern within the bundle.

The creation of mist flow within a bundle results in increased pressure drop in the vapor flowing out of the bundle as well as the removal of liquid refrigerant from the bundle without its having had a chance for heat exchange contact with a tube in the tube bundle. Therefore, such mist flow not only results in detrimental and efficiency-robbing pressure drop within the evaporator but can starve a portion of the tube bundle, most often its lower central portion, of liquid refrigerant and cause the dryout thereof. That too is detrimental to the efficiency of the evaporator. Vapor lanes are therefore sized to minimize the creation of mist flow in the tube bundle and the pressure drop associated with it.

The maximum acceptable Weber number for combined droplet/vapor flow in a tube bundle is determined for a particular bundle configuration and location via experimental test. Vapor lanes are then sized and positioned within the tube pattern so as to maintain local Weber numbers below such maximum values for each section of the tube bundle. By doing so, refrigerant vapor flows preferentially out of the tube bundle at predetermined locations and velocities which minimize the affect of vapor flow out of the tube bundle on the downward flow of liquid refrigerant within the tube bundle.

Referring now to FIG. 7, the effect of vapor lanes on the flow of liquid and vapor within the tube bundle is further explained. In that regard, if angle $\alpha$ exceeds angle $\theta$, liquid droplet 110 will be horizontally displaced to the extent that in falling downward it will bypass the row of tubes vertically aligned directly below the tube of its origin. Vapor lanes are therefore sized and located in the tube bundle so as to control angle $\alpha$.

In a rectangular tube bundle, diagonal liquid flow is generally not desirable, possibly other than in the very upper region of the tube bundle where a triangular-pitched geometry is used to even out of the flow of liquid refrigerant across the width of the tube bundle and where the effect of vapor flow is not, relatively speaking, as significant. Vapor lanes are employed in such bundles to maintain, to the extent possible, angle $\alpha$ less than angle $\theta$ so that liquid droplets fall vertically downward onto the tube below in the same vertical row.

In heat exchangers where the tube bundle is not necessarily rectangular in nature and may contain individual tubes which are horizontally outside of the portion of the tube bundle overlain by the distributor or which are, for instance, trapezoidal, with the lower portion of the tube bundle being wider than the upper portion, the use of vapor lanes to selectively permit angle $\alpha$ to exceed angle $\theta$ may be desirable in some regions of the tube bundle to promote controlled horizontal liquid refrigerant migration within the bundle. Regardless the design strategy used, the use of vapor lanes of appropriate size and which are appropriately positioned provides for optimum falling-film performance by maximizing the wetted tube surface area therein as a percentage of the total tube surface area available for heat transfer.

The use of vapor lanes has the additional advantage of permitting water box baffles (also referred to as ribs) to be located within or aligned with vapor lanes when positioned against the tube sheet on the side thereof which is opposite the side of the tube sheet where the tube bundle is disposed. Such baffles/ribs apportion and direct the flow of fluid through the tubes in defined sections of the tube bundle. By the use of appropriately placed and spaced vapor lanes, not only is the lateral exit of vapor from the tube bundle facilitated but the need to machine clearances or a complicated water box baffle configuration to account for non-uniform the tube patterns and/or the lack of a defined "lane", such as the vapor lanes in the preferred embodiment, is eliminated. Appropriately spaced and placed vapor lanes will, therefore, facilitate multiple water box options and pass strategies while eliminating time consuming, expensive and complicated machining steps in the fabrication of evaporator waterboxes.

For example, in the two-pass water box baffle configuration of evaporator 20 in FIGS. 2, 3 and 8 the fluid to be cooled by refrigerant in evaporator 20 is delivered first into waterbox 200 through inlet piping 202 and then into lower volume 204 of the waterbox which is upstream of tube sheet 206 and below water box baffle 208. Such fluid then enters the ends 210 of that portion 212 of the individual tubes 58 of the tube bundle that open into lower volume 204 and flows down the length of evaporator 20 in a first pass therethrough.

At the other end of evaporator 20 the fluid is re-directed by waterbox 214 into the tubes in the upper section of the tube bundle. The fluid flows back down the length of evaporator 20 through such tubes in a second pass. The fluid then enters upper volume 216 of waterbox 200 which is defined downstream of tube sheet 206 and above baffle 208. The fluid then flows out of evaporator 20 through outlet piping 218.

As will be appreciated, the fluid to be cooled in evaporator 20 in the embodiment of FIGS. 2, 3 and 8 makes two passes through the evaporator and is thus afforded two chances to be cooled by the refrigerant therein. Volumes 204 and 216 in waterbox 200 are separated by water box baffle 208 which is configured to follow and coincide with (albeit on the other side of the tube sheet) a vapor lane, such as vapor lane 74, defined in the tube bundle pattern. By their existence, such vapor lanes result in generally linear and relatively large and well defined solid and flat surface on the tube sheet against which the waterbox baffle can abut.

It is to be noted that the flow of the fluid to be cooled through the tube bundle in evaporator 20 can either be bottom to top or top to bottom. In the case of a falling film evaporator, bottom to top flow, as illustrated in FIG. 3, is preferred in order to take advantage of the high heat flux that will be found in the relatively shallow pool 54 of oil-rich liquid refrigerant that will exist at the bottom of a falling film evaporator. In the case of a flooded evaporator, where the liquid level is high within the evaporator shell and wherein the majority of the tubes in the tube bundle are immersed, the vertical direction of the flow of the fluid through the tube bundle is not as critical.

In prior evaporators, waterbox baffles were often complicated and had to be configured/machined to weave their way around open tube ends in an evaporator's tube sheets for lack of a well defined, solid and contiguous surface on a tube sheet against which to abut. The fabrication and assembly of evaporator 20, by virtue of the fact that the abutment of the edge of waterbox baffle 208 against the tube sheet can coincide with the location of a vapor lane in the tube bundle, such as vapor lane 74, is therefore facilitated and the expense thereof is reduced.

In applications where it is preferable for the load-cooling fluid to make three passes through the evaporator, the water box baffles are configured to follow two vapor lanes such as vapor lanes 72 and 74 in FIG. 2. In that circumstance the water box baffles are positioned to first cause the load-cooling fluid to pass in a first direction down the length of the evaporator through the tubes located vertically below vapor lane 74. The fluid is then directed by the water box baffle arrangement to make a second lengthwise pass of the evaporator through those tubes in the tube bundle that are below vapor lane 72 but above vapor lane 74. A third pass back through the evaporator is accomplished through the portion of the tube bundle above vapor lane 74. In FIG. 2, the inlet and outlet to the waterbox are on the same side of evaporator 20. As will be apparent, in a three-pass configuration the inlet and outlet piping through which the load cooling fluid flows would connect to opposite ends of the evaporator.

Referring now to FIG. 9, it will be appreciated that the vapor lanes in evaporator 20 can also be configured within tube bundle 52 in a manner which allows for the use of individual tubes 58 of different diameters within individual tube sections. In that regard, tube bundle 52 is comprised of sections 300, 302, 304, 306 and 308 which are defined by vapor lanes 310, 312, 314 and 316. Within each of tube sections 300, 302, 304, 306 and 308 multiple tube diameters and/or tube pitches (spacing) may be employed with the size and location of the vapor lanes therebetween being maintained constant.

For instance, larger diameter tubes 320, which are, perhaps, one inch in diameter, may be used throughout the tube bundle in applications or instances where use of a lower efficiency evaporator is sufficient or is appropriate for cost or other reasons. This size tube and the spacing thereof in a tube section is illustrated to the left of line 324 in FIG. 9. Smaller diameter tubes 322 which may, for instance, be three-quarter inch diameter tubes, can be used where a higher efficiency evaporator is appropriate or justified. This size tube and the spacing thereof in a tube section is illustrated to the right of line 324 in FIG. 9.

The use of smaller diameter tubes will allow for the placement of more tubes in a tube section than will the use of larger diameter tubes, making comparatively more tube surface available for heat transfer in the same space/volume, all while maintaining vapor lane sizing/location constant to facilitate the cost effective fabrication of such different evaporators. As will be appreciated, tubes of more than one diameter can be used in an evaporator although evaporator and tube sheet fabrication would be complicated thereby.

By the use of more or fewer tubes within individual tube sections, while maintaining vapor lane sizing and location generally constant, the capacity of the evaporator for heat transfer may be increased or decreased, as required for a particular application. Further, by the use of commonly positioned and sized vapor lanes but tubes of different diameters, as taught hereby, it has been found that evaporators of multiple capacities and efficiencies can be fabricated using a shell the length and inside diameter of which are the same. Such an evaporator design is therefore appropriate for use in chillers across a significant portion of the tonnage range of a chiller product line. As will be appreciated, the fabrication expense associated with producing the family of chillers is thereby reduced while the ease and efficiency of fabrication is enhanced since the remainder of the chiller components, their size and location relative to the evaporator need not change.

Referring now to FIG. 10, an alternative embodiment of the evaporator of the present invention illustrates the still further versatility thereof. In that regard, not only does the evaporator of the present invention permit the use of multiple different tube patterns and multiple tube diameters and tube pitches within a tube bundle while maintaining vapor lane position and sizing constant, it facilitates the use of more than one distributor by which to accomplish refrigerant distribution across the top of the tube bundle.

In that regard, in the evaporator of the embodiment of FIG. 10, two, two-phase refrigerant distributors 400 and 402 run generally the length of evaporator 20 and are supported in structure 404 which incorporates not only combination suction baffles/mounting flanges 66, as was the case in the earlier described embodiment, but perforations 406 which run generally the length of the tube bundle 52 between the individual distributors 400 and 402. Perforations 406 communicate between upper portion 68 of the interior of the evaporator shell and the space 408 between individual right and left tube banks 410 and 412. Each tube bank will include discrete tube sections defined by vapor lanes.

The perforations 406 of structure 404 between individual distributors in an evaporator employing multiple two-phase distributors are sized so that local vapor velocities within the underlying tube bundle are controlled and are kept below a critical value which, if exceeded, would disrupt liquid flow downward through the tube bundle, particularly in locations where such disruption might cause liquid to be carried out of the tube bundle and, potentially, into upper portion 68 of the evaporator shell. Keeping lateral vapor velocities in the tube bundle as low as possible, particularly in locations immediate the underside of two-phase distributors, is advantageous and the definition of an internal vapor space such as space 408 and a vertical exit for gas from that space, such as through perforations 406, accomplishes that purpose.

While distributors 400 and 402 are functionally similar to distributor 50 of the preferred embodiment, the use of two such distributors as opposed to one results in the creation of an additional flow area, in the form of the space 408 between the tube banks, by which to conduct vapor out of and away from the tube bundle and into the upper portion 68 of the evaporator. Additionally, by the use of multiple distributors which are narrower in width but which still overlie the tubes at the top of the tube bundle, the performance of the distributors themselves is enhanced for the reason that while the lengthwise distribution of two-phase refrigerant is relatively simple and efficient, the widthwise distribution thereof within the distributor is not.

Further, additional cost reductions and economy of scale in the production of evaporators of the design of the present invention can be accomplished by employment of an appropriate number of identical distributors in accordance with the capacity of the evaporator in which such distributors are used. For instance, two or more modular tube banks, such as tube banks 410 and 412, can be employed in such an evaporator with each tube bank being overlain by one two-phase refrigerant distributor. Each tube bank can, for example, be designed to provide a specific number of tons of cooling and can be separately fabricated.

As mentioned above, the narrower the distributor, the better is the ability of the distributor to apportion two-phase refrigerant across the width of the tube bundle it overlies. By the use of two 250 ton tube banks and a refrigerant two-phase distributor associated with each, as is the case with the evaporator of FIG. 10, a 500 ton evaporator can economically be fabricated, distributor width can be advantageously reduced, vapor exit from the tube bundle enhanced (as the result of the creation of a space between individual tube banks) and vapor lane width can be reduced, as can the footprint of the chiller and diameter of the evaporator shell. All of these factors cooperate to significantly reduce the cost of the evaporator's water boxes and tube sheets, the cost of the evaporator overall and, therefore, the overall cost of the chiller.

Referring additionally now to FIG. 11, it will be appreciated that a relatively shallow pool 500 of liquid refrigerant will exist in the lower portion of the evaporator shell. That pool, as noted earlier, will contain oil that must be returned to the chiller's compressor for use therein. Generally speaking, the liquid pool at the bottom of evaporator 20 submerges no more than 25% of the total heat transfer surface area present within tube bundle 52 (25% of the total tube count in circumstances where a single tube diameter is used throughout the tube bundle).

While about one-third of the tubes in the tube bundle will typically be disposed in the lower tube section 502, one-half or less of the tubes in the lower tube section will typically be immersed in the liquid pool. It is also to be noted, with respect to the tubes in lower section 502 of tube bundle 52, that they are of triangular pitch configuration for the reason that more tubes can be packed thereinto taking into account the curvature of the shell at the bottom thereof which is the shell location that most affects tube bundle geometry.

The nominal level of the liquid pool is indicated at 504. While the tubes immersed in pool 500 will be in direct heat exchange contact with the surrounding liquid, the remainder of the tubes in the lower section of the tube bundle will not only receive liquid refrigerant dripped from above that has made its way downward through the tube bundle, but liquid refrigerant that is sprayed upward from the surface of pool 500 as a result of the boiling of liquid refrigerant that occurs within the pool. Preferably, the spray resulting from such boiling is not sufficiently energetic to cause significant splashing/spraying of liquid refrigerant upward into vapor lane 506 or to result in a significant portion of the liquid portion of the spray being carried out of the vicinity of the tube bundle entrained refrigerant vapor.

Schematically illustrated in FIG. 11 is the addition of an oil concentrator 508 to evaporator 20. As has been mentioned, a certain amount of oil will flow out of refrigerant distributor 50 together with the two-phase refrigerant issuing thereoutof. As the liquid refrigerant portion of the two-phase mixture evaporates in its downward flow through the tube bundle, the concentration of oil in the remainder of the downward-flowing liquid refrigerant increases. In the embodiment of FIG. 11, a portion of the tubes in lower tube section 502, such as tubes 510, are disposed internal of oil concentrator 508 which runs generally the length of the evaporator shell.

Concentrator 508 defines an inlet 512 generally at one end of the evaporator shell. Liquid from pool 500 is drawn into the concentrator through inlet 512, is drawn therethrough and is then drawn out of the concentrator via outlet 514 by apparatus such as pump 34 or an eductor (not shown). Outlet 514 is located at the opposite end of the evaporator shell from inlet 512. Therefore, liquid flows out of concentrator 508 after flowing down the length thereof through the volume 516 which the concentrator defines.

During the flow of such liquid down the length of the evaporator shell within concentrator volume 516, it is in heat exchange contact with the tubes 510 that are disposed therein and through which relatively warm fluid flows. During such flow, refrigerant boils out of the liquid, still further concentrating the oil in the liquid that flows through the concentrator. The refrigerant vaporized in this process is conducted out of concentrator 508 through one or more vapor outlets 520 that communicate between concentrator volume 516 and a location from which it can flow to/into upper portion 68 of the evaporator shell without affecting the downward flow of liquid refrigerant through the tube bundle.

With this arrangement, oil return from the evaporator to the system compressor is enhanced and oil concentration in the majority of the liquid pool within the evaporator is kept low. Because the amount and concentration of oil in the evaporator is less, the level of pool 500 and the control thereof is more forgiving than is the case when oil concentration in the evaporator pool is higher. As an alternative to the use of a single inlet to oil concentrator 508 and the exit of liquid which drawn down the entire length thereof, two or more concentrator inlets can be employed with outlet 514 being located generally about one-half the distance down the length of the evaporator shell.

It is to be noted that in the ideal case the design criteria for evaporator 20, with respect to the distribution of refrigerant across its tube bundle, is to make such distribution as uniform as possible. That is the criteria to which the evaporator of the preferred embodiment is designed.

However, the present invention does contemplate evaporators in which non-uniform distribution of refrigerant across the tube bundle is purposefully and strategically accomplished so that refrigerant is distributed internal of the shell in greater quantities in some locations than in others. In each case, however, by the use of appropriately located and spaced vapor lanes, the overall heat transfer efficiency of the evaporator will be enhanced.

While the present invention has been described in terms of preferred and alternative embodiments, it will be appreciated that other modifications and alterations thereto are contemplated that fall within the teachings herein and that, as such, the scope of the present invention is not limited to the described embodiments.

With that in mind, what is claimed is:

1. A refrigeration system comprising:

a refrigerant gas compressor;

a condenser, said condenser receiving compressed gas from said compressor and condensing said gas to the liquid state;

a first expansion device, said expansion device being downstream of said condenser and creating a two-phase mixture of refrigerant gas and liquid refrigerant; and a falling film evaporator, said evaporator having a shell, a tube bundle, a vapor outlet and a refrigerant distributor, said vapor outlet being connected for flow to said compressor and the tubes of said tube bundle running horizontally in said shell, said refrigerant distributor being disposed above said tube bundle within said shell and receiving liquid refrigerant from said expansion device, said distributor depositing liquid refrigerant vertically downward, generally unassisted by pressure, onto the top of said tube bundle, said tube bundle having at least two tube sections and defining at least one vapor lane, said vapor lane being an essentially unobstructed flow path between said tube sections that is sized to facilitate the conduct of refrigerant gas out of the interior of said tube bundle to an exterior side thereof at a velocity and in a manner such that the flow of liquid refrigerant downward through said tube bundle and across said vapor lane is generally unaffected by the cross-flow of refrigerant vapor out of the interior of said tube bundle through said vapor lane.

2. The refrigeration system according to claim 1 wherein a portion of the liquid refrigerant deposited by said distributor onto the top of said tube bundle makes its way to the bottom of and pools in said evaporator, the majority of the tubes of said tube bundle being disposed above said pool.

3. The refrigeration system according to claim 2 wherein said at least one vapor lane is sized so that the downward flow of liquid refrigerant across said vapor lane within said tube bundle is substantially unaffected by the conduct of refrigerant gas through said vapor lane to an exterior side of said tube bundle.

4. The refrigeration system according to claim 3 wherein said distributor is positioned in said shell so that refrigerant conducted out of the interior of said tube bundle to an exterior side thereof by said vapor lane flows to said vapor outlet generally unobstructed by said refrigerant distributor.

5. The refrigeration system according to claim 4 wherein said refrigerant distributor is a two-phase refrigerant distributor which receives both liquid refrigerant and refrigerant gas from said first expansion device, said distributor depositing liquid refrigerant in generally controlled and predictable quantities across the length and width of the portion of the top of the tube bundle that is overlain by said distributor.

6. The refrigeration system according to claim 5 wherein one quarter or fewer of the tubes in said tube bundle are unimmersed in said pool at the bottom of said evaporator.

7. The refrigeration system according to claim 5 wherein said at least one vapor lane is defined within said tube bundle so as to provide a generally unobstructed flow path from the interior of said tube bundle to two exterior sides thereof and wherein liquid refrigerant is deposited in generally uniform quantities across the length and width of the portion of the top of the tube bundle that is overlain by said distributor.

8. The refrigeration system according to claim 5 wherein the flow of liquid refrigerant out of said distributor is generally in droplet form and wherein said refrigerant distributor and said tube bundle define a vapor space therebetween, the vertical dimension of said vapor space being the distance between the underside of said distributor and the top of said tube bundle, said distance being predetermined to facilitate the lateral flow of refrigerant gas out of said vapor space at a velocity which does not substantially disrupt the generally vertically downward deposit of liquid refrigerant droplets from said distributor onto the top of said tube bundle.

9. The refrigeration system according to claim 8 wherein said at least one vapor lane provides a generally continuous flow path from the interior of said tube bundle to two exterior sides thereof from where said refrigerant gas flows from said two exterior sides of said tube bundle to said vapor outlet via flow paths that are essentially unobstructed by said distributor.

10. The refrigeration system according to claim 5 wherein refrigerant flowing from said compressor, to and through said condenser, to and through said first expansion device and to and through said distributor carries with it oil that becomes entrained in said refrigerant within said compressor, said oil making its way into said pool of liquid refrigerant at the bottom of said evaporator shell, said refrigeration system further comprising apparatus for returning oil that makes its way into said pool of liquid refrigerant at the bottom of said evaporator to said compressor.

11. The refrigeration system according to claim 10 wherein said distributor overlies the majority of the length and width of the top of said tube bundle and wherein said at least one vapor lane facilitates the conduct of refrigerant gas from the interior of said tube bundle to first and second exterior sides thereof, said distributor depositing liquid refrigerant in generally uniform quantity across the length and width of the top of the tube bundle which is overlain by said distributor.

12. The refrigeration system according to claim 11 wherein a majority of the tubes in said tube bundle are oriented in a rotated triangular-pitch configuration.

13. The refrigeration system according to claim 12 wherein a minority portion of the tubes in said tube bundle are oriented in a triangular-pitch configuration, the tubes in the uppermost portion of said tube bundle being oriented in said triangular-pitch configuration.

14. The refrigeration system according to claim 10 wherein said first expansion device is disposed adjacent the entrance to said distributor so as to reduce stratification in the two-phase refrigerant mixture received by said distributor from said first expansion device and wherein said refrigerant distributor and said tube bundle define a vapor space therebetween, the vertical dimension of said vapor space being the distance between the underside of said distributor and the top of said tube bundle, said distance being predetermined to facilitate the lateral flow of refrigerant gas out of said vapor space at a velocity which does not substantially disrupt the vertically downward deposit of liquid refrigerant by said distributor onto the top of said tube bundle.

15. The refrigeration system according to claim 10 further comprising an oil concentrator, said oil concentrator being disposed in the bottom of said evaporator, at least one tube of said tube bundle being disposed in said oil concentrator, a portion of the mixture of liquid refrigerant and oil that pools at the bottom of said evaporator entering said oil concentrator, a portion of the liquid refrigerant that enters said concentrator being vaporized by heat exchange contact with said at least one tube, refrigerant vaporized in said concentrator exiting said concentrator and being returned into the interior of said evaporator shell and the remaining portion of the liquid refrigerant and oil in said concentrator being delivered from said oil concentrator to said compressor by said oil return apparatus.

16. The refrigeration system according to claim 5 wherein said evaporator has a tube sheet and includes a waterbox, said waterbox and said tube bundle being disposed on opposite sides of said tube sheet, the ends of the tubes of said tube bundle penetrating said tube sheet, said waterbox having a baffle, said waterbox baffle, by its abutment with said tube sheet, being determinative of which of the tubes in said tube bundle initially receive the heat transfer medium that flows into said evaporator, said waterbox baffle abutting said tube sheet in a location that corresponds to a vapor lane defined by said tube bundle on the other side of said tube sheet.

17. The refrigeration system according to claim 5 wherein said tube bundle defines at least two vapor lanes, each of said at least two vapor lanes being generally unobstructed flow paths running from the interior to first and second exterior sides of said tube bundle.

18. The refrigeration system according to claim 17 wherein each of said at least two vapor lanes are sized so that the downward flow of liquid refrigerant thereacross within said tube bundles is substantially unaffected by the conduct of refrigerant gas out of the interior of said tube bundle through said vapor lanes and wherein a portion of at least one of said at least two vapor lanes has a vertically upward bias.

19. The refrigeration system according to claim 17 further comprising a baffle for regulating the flow to said vapor outlet of refrigerant gas which is conducted to the exterior sides of said tube bundle through said vapor lanes, said baffle supporting said distributor within said shell.

20. The refrigeration system according to claim 5 further comprising a baffle, said baffle being interposed between the vapor outlet of said evaporator and the location at the exterior side of said tube bundle to which said vapor lane conducts refrigerant gas from interior of said tube bundle, said baffle regulating the flow of refrigerant gas to said vapor outlet.

21. The refrigeration system according to claim 20 wherein said baffle supports said distributor within said shell.

22. The refrigeration system according to claim 21 wherein said baffle defines a plurality of apertures through which refrigerant gas flows enroute from said tube bundle to said vapor outlet.

23. The refrigeration system according to claim 21 wherein said tube bundle defines at least two vapor lanes, each of said at least two vapor lanes providing a generally unobstructed flow path from the interior of said tube bundle to two exterior sides thereof and at least one of said vapor lanes having a vertically upward bias.

24. The refrigeration system according to claim 1 wherein said evaporator has at least two refrigerant distributors, each of said distributors receiving a two-phase refrigerant mixture from said expansion device.

25. The refrigeration system according to claim 24 wherein said tube bundle has at least two horizontally adjacent tube banks, each of said tube banks being overlain by at least one two-phase refrigerant distributor and cooperating to define a generally vertically running space therebetween, each of said tube banks defining at least one vapor lane to facilitate the flow of refrigerant gas from interior thereof into said vertically running space, the flow path for refrigerant gas from said vertically running space to said vapor outlet being generally unobstructed by a refrigerant distributor.

26. The refrigeration system according to claim 25 wherein said distributors are supported in said shell by a baffle, said baffle regulating the flow of refrigerant gas to the vapor outlet of said evaporator.

27. The refrigeration system according to claim 1 wherein said evaporator has a waterbox and a tube sheet, said tube bundle and said first waterbox being disposed on opposite sides of said tube sheet, said tube sheet being penetrated by the ends of the tubes of said tube bundle, the portion of said tube sheet that is unpenetrated by said tube ends and which corresponds to the location of a vapor lane defined by said tube bundle being generally solid and continuous, said waterbox including a baffle, said baffle abutting said generally solid and continuous portion of said tube sheet that corresponds to the location of a vapor lane defined by said tube bundle and directing the flow of said heat transfer medium, as it enters said evaporator, into said first portion of the tubes.

28. The refrigeration system according to claim 27 wherein said first portion of the tubes of said tube bundle is generally vertically below said second portion of the tubes of said tube bundle so that the flow of said heat transfer medium into, through and out of said evaporator is from the bottom to the top of said tube bundle.

29. The refrigeration system according to claim 1 further comprising an economizer and a second expansion device and wherein said refrigerant distributor is a two-phase refrigerant distributor that overlies the majority of the length and width of the top of said tube bundle and deposits liquid refrigerant in generally uniform quantity thereover, said second expansion device receiving liquid refrigerant from said condenser and creating a two-phase mixture of liquid refrigerant and refrigerant gas that is communicated to said economizer, the gaseous portion of said two-phase mixture being communicated from said economizer to said compressor and the liquid portion thereof being communicated to said first expansion device.

30. A falling film evaporator for a vapor compression refrigeration system comprising:

a shell, said shell having a vapor outlet;

a tube bundle, the tubes of said tube bundle running horizontally in said shell, said tube bundle having at least one vapor lane and at least two tube sections, said vapor lane being an essentially unobstructed flow path that is defined between said at least two tube sections through which refrigerant gas flows from the interior to an exterior side of said tube bundle and thence to said vapor outlet, said vapor lane being sized so that the flow of refrigerant gas therethrough to said exterior side of said tube bundle is at a velocity which generally does not disrupt the downward flow of liquid refrigerant through said tube bundle and across said vapor lane; and a refrigerant distributor, said refrigerant distributor being mounted vertically above said tube bundle within said shell and depositing liquid refrigerant, in generally predictable and controlled quantities, onto the top of said tube bundle by force of gravity and generally unassisted by pressure so that said liquid refrigerant falls out of said distributor generally vertically downward onto the top of said tube bundle.

31. The falling film evaporator according to claim 30 wherein a portion of the liquid refrigerant issuing from said distributor makes its way to the bottom of and pools in said evaporator, the majority of the tubes of said tube bundle of said evaporator being disposed vertically above said pool.

32. The falling film evaporator according to claim 31 wherein said refrigerant distributor is a two-phase distributor and is positioned so that the flow of refrigerant gas out of said vapor lane to said vapor outlet is generally unobstructed by said refrigerant distributor.

33. The falling film evaporator according to claim 32 wherein said at least one vapor lane is sized so that the velocity of refrigerant gas flowing therethrough from the interior of said tube bundle to said exterior side thereof does not substantially affect the vertically downward flow of liquid refrigerant across said vapor lane within said tube bundle.

34. The falling film evaporator according to claim 33 wherein the liquid refrigerant deposited onto the top of said tube bundle by said distributor is generally in droplet form and is in generally uniform quantity across the length and width of the portion of the top of the tube bundle which is overlain by said distributor.

35. The falling film evaporator according to claim 34 wherein said at least one vapor lane provides a generally continuous and unobstructed flow path for refrigerant gas from the interior of said tube bundle to two exterior sides thereof from where said refrigerant gas flows to said vapor outlet essentially unobstructed by said distributor.

36. The falling film evaporator according to claim 35 wherein said refrigerant distributor, in addition to receiving and distributing liquid refrigerant and refrigerant vapor internal of said shell, receives oil that makes its way thereto from the compressor of said vapor compression refrigeration system, said oil making its way into said pool of liquid refrigerant at the bottom of said evaporator shell.

37. The falling film evaporator according to claim 35 wherein said refrigerant distributor and said tube bundle define a vapor space therebetween, the vertical dimension of said vapor space being the distance between the underside of said distributor and the top of said tube bundle, said distance being predetermined so as to facilitate the lateral flow of refrigerant gas out of said vapor space at a velocity which essentially does not disrupt the generally vertically downward fall of liquid refrigerant droplets from said distributor onto the top of said tube bundle, said at least one vapor lane likewise being sized so that the velocity of refrigerant gas flowing therethrough from the interior to the exterior of said tube bundle does not substantially affect the vertically downward flow of liquid refrigerant through said tube bundle and across said vapor lane.

38. The falling film evaporator according to claim 35 further comprising a baffle, said baffle being interposed between said vapor outlet and the locations at the exterior sides of said tube bundle to which said at least one vapor lane delivers refrigerant gas from the interior thereof and regulating the flow of refrigerant gas from the exterior sides of said tube bundle to said vapor outlet.

39. The falling film evaporator according to claim 38 wherein said baffle supports said distributor within said shell.

40. The falling film evaporator according to claim 35 further comprising an oil concentrator, said oil concentrator being disposed in the bottom of said evaporator, at least one tube of said tube bundle being disposed in said oil concentrator, a mixture of liquid refrigerant and oil entering said oil concentrator from the pool of liquid refrigerant and oil that is found at the bottom of said evaporator, a portion of the liquid refrigerant in said mixture that enters said concentrator being vaporized within said concentrator, the vaporized refrigerant exiting said concentrator and being returned into the interior of said evaporator shell, the remaining portion of said mixture in said concentrator containing an increased concentration of oil as a result of the vaporization of liquid refrigerant within said oil concentrator.

41. The falling film evaporator according to claim 35 wherein a majority of the tubes in said tube bundle are oriented in a rotated triangular-pitch configuration so that liquid refrigerant flowing downward through the majority of the tubes in said tube bundle falls generally from a first horizontal row of tubes in said tube bundle onto tubes in the horizontal row of tubes immediately below.

42. The falling film evaporator according to claim 41 wherein a minority portion of the tubes in said tube bundle are oriented in a triangular-pitch configuration.

43. The falling film evaporator according to claim 35 wherein said evaporator has a tube sheet and a waterbox, said tube bundle and said waterbox being on opposite sides of said tube sheet, the ends of the tubes of said tube bundle penetrating said tube sheet, said waterbox having a baffle which, by its abutment with said tube sheet, determines which of the tubes in said tube bundle initially receive the heat transfer medium that flows into said evaporator, said waterbox baffle abutting said tube sheet in a location that corresponds to a vapor lane defined by said tube bundle on the other side of said tube sheet.

44. The falling film evaporator according to claim 35 wherein said evaporator has at least two refrigerant distributors, each of said distributors being two-phase refrigerant distributors.

45. The falling film evaporator according to claim 35 wherein said tube bundle has at least two tube banks, each of said tube banks being overlain by at least one refrigerant distributor, said tube tanks cooperating to define a generally vertically running space therebetween and each of said tube banks defining at least one vapor lane to facilitate the flow of refrigerant gas from the interiors thereof into said vertically running space, the flow path for refrigerant gas to said vapor outlet from said vertically running space being generally unobstructed by a refrigerant distributor.

46. The falling film evaporator according to claim 35 wherein said tube bundle defines at least two vapor lanes, both of said vapor lanes defining a generally continuous and unobstructed flow path from the interior of said tube bundle to two exterior sides thereof.

47. The falling film evaporator according to claim 35 further comprising an expansion device, said expansion device being disposed adjacent the inlet to said refrigerant distributor and delivering two-phase refrigerant thereinto.

48. A method for managing vapor flow internal of a falling film evaporator which employs a two-phase refrigerant distributor and which is used in a vapor compression refrigeration system comprising the steps of:

positioning said refrigerant distributor vertically above the tube bundle within the shell of said evaporator;

delivering a two-phase mixture of liquid refrigerant and refrigerant gas into said distributor;

flowing said two-phase refrigerant mixture internal of said distributor so that at least the liquid portion of said two-phase mixture is made available for distribution generally throughout the length and width thereof;

depositing, in a generally vertically downward direction and in relatively low-energy droplet form, the liquid refrigerant portion of said two-phase mixture across the portion of the top of said tube bundle that is overlain by said distributor;

flowing liquid refrigerant deposited onto the top of said tube bundle generally vertically downward therethrough;

defining at least one generally unobstructed vapor lane within said tube bundle that runs from the interior to an exterior side thereof, said vapor lane dividing said tube bundle generally into two tube sections and being sized to conduct refrigerant gas from the interior to an exterior side of said tube bundle at a velocity which generally does not disrupt the downward flow of liquid refrigerant through said tube bundle and across said vapor lane; and flowing the refrigerant gas conducted via said vapor lane out of the interior of said tube bundle to the vapor outlet of said evaporator by a path that is generally unobstructed by said distributor.

49. The method according to claim 48 comprising the further step of collecting at least a portion of the liquid refrigerant that is deposited onto the top of and flows downward through said tube bundle in a pool at the bottom of said evaporator shell.

50. The method according to claim 49 disposing a minority portion of the tubes of said tube bundle in said pool of liquid refrigerant that is collected in the bottom of said evaporator shell.

51. The method according to claim 50 comprising the further step sizing said vapor lane so that the downward flow of liquid refrigerant across said vapor lane is substantially unaffected by the conduct of refrigerant gas from the interior of said tube bundle through said vapor lane to an exterior side thereof.

52. The method according to claim 51 wherein said step of defining said vapor lane includes the step of providing a generally unobstructed and continuous flow path for the conduct of refrigerant gas out of the interior of said tube bundle to two exterior sides thereof.

53. The method according to claim 52 wherein said step of depositing liquid refrigerant onto the top of said tube bundle includes the step of depositing generally uniform quantities of liquid refrigerant across the length and width of said tube bundle that is overlain by said distributor.

54. The method according to claim 53 comprising the further step of defining a vapor space between said distributor and the top of said tube bundle, the vertical dimension of said vapor space being the distance between the underside of said distributor and the top of said tube bundle, said distance being predetermined to facilitate the lateral flow of refrigerant gas out of said vapor space at a velocity which does not substantially disrupt the generally vertically downward deposit of liquid refrigerant from said distributor to the top of said tube bundle.

55. The method according to claim 53 comprising the further step of orienting a majority of the tubes of said tube bundle that are located vertically above said pool in said evaporator in a rotated triangular-pitch configuration so that the downward flow of liquid refrigerant through said majority of tubes located above said pool is from the tubes in one horizontal row of tubes in said tube bundle downward onto corresponding vertically aligned tubes in the horizontal row of tubes immediately below said one horizontal row.

56. The method according to claim 53 comprising the further step of regulating the flow of refrigerant gas from said tube bundle to said vapor outlet by a use of a baffle.

57. The method according to claim 56 comprising the further step of supporting said distributor in said evaporator shell with said baffle.

58. The method according to claim 53 comprising the further step of reducing the stratification in the two-phase mixture of refrigerant received into said distributor by disposing an expansion device adjacent the entry to said refrigerant distributor.

59. The method according to claim 53 comprising the further step of defining a plurality of vapor lanes in said tube bundle.

60. The method according to claim 53 wherein said evaporator includes a tube sheet and a waterbox, the ends of the tubes of said tube bundle penetrating said tube sheet and said tube bundle and waterbox being disposed on opposite sides of said tube sheet, and further comprising the step of directing the heat transfer medium that flows through said evaporator into a first portion of the tubes of said tube bundle by the use of a waterbox baffle that abuts said tube sheet in a location that corresponds to a vapor lane defined by said tube bundle.

61. The method according to claim 53 wherein said tube bundle has at least two tube banks, each of said tube banks being overlain by a refrigerant distributor, and comprising the further steps of defining a generally vertically running space between said tube banks; defining at least one vapor lane in each of said tube banks that opens into said generally vertically running space; conducting refrigerant gas out of the interior of each of said tube banks into said vertically running space; and, conducting refrigerant gas from said vertically running space to the vapor outlet of said evaporator through a flow path that is generally unobstructed by a refrigerant distributor.

62. The method according to claim 53 comprising the further steps of receiving oil as well as two-phase refrigerant into said distributor; flowing said oil out of said distributor and downward through said tube bundle into said pool of liquid refrigerant at the bottom of said evaporator shell; and returning a mixture of liquid refrigerant and oil from said pool at the bottom of said evaporator to the compressor of said vapor compression refrigeration system.

63. The method according to claim 62 comprising the further steps of increasing the concentration of oil in the mixture of liquid refrigerant and oil that is returned from said evaporator pool to said compressor in said returning step by vaporizing a portion of the liquid refrigerant in said mixture within said shell.

64. The method according to claim 53 comprising the further steps of reducing the pressure of liquid refrigerant received from the condenser a first time so as to create a lower pressure mixture of liquid and gaseous refrigerant; delivering said gaseous refrigerant portion of said lower pressure refrigerant mixture to the compressor of said refrigeration system; lowering the pressure of the liquid portion of said lower pressure refrigerant mixture a second time so as to create a second and still lower pressure mixture of liquid refrigerant and refrigerant gas; and wherein the two-phase mixture of refrigerant delivered in said delivering step is said second and still lower pressure mixture of liquid refrigerant and refrigerant gas.

* * * * *